US010732541B2

(12) United States Patent
Soda

(10) Patent No.: US 10,732,541 B2
(45) Date of Patent: Aug. 4, 2020

(54) IMAGE FORMING APPARATUS

(71) Applicant: KYOCERA Document Solutions Inc., Osaka (JP)

(72) Inventor: Tomohisa Soda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/511,457

(22) Filed: Jul. 15, 2019

(65) Prior Publication Data

US 2020/0033753 A1 Jan. 30, 2020

(30) Foreign Application Priority Data

Jul. 26, 2018 (JP) ..... 2018-140319

(51) Int. Cl.
*G03G 15/08* (2006.01)
*G03G 15/00* (2006.01)

(52) U.S. Cl.
CPC ..... *G03G 15/0856* (2013.01); *G03G 15/0849* (2013.01); *G03G 15/0867* (2013.01); *G03G 15/556* (2013.01); *G03G 2215/0888* (2013.01)

(58) Field of Classification Search
CPC ..... G03G 15/556; G03G 15/0856; G03G 15/0849
See application file for complete search history.

(56) References Cited

U.S. PATENT DOCUMENTS 5,374,977 A * 12/1994 Shiina ..... G03G 15/0822 399/260
2005/0244173 A1* 11/2005 Akashi ..... G03G 15/086 399/27
2008/0304838 A1 12/2008 Suenaga et al.
2011/0085807 A1* 4/2011 Kawamura ..... G03G 21/1825 399/27
2011/0222871 A1* 9/2011 Suzuki ..... G03G 15/0872 399/27
2011/0286754 A1* 11/2011 Otake ..... G03G 15/0855 399/27

FOREIGN PATENT DOCUMENTS

JP 01035578 A * 2/1989 ..... G03G 15/0879
JP 03048266 A * 3/1991
JP 2008-304822 A 12/2008

* cited by examiner

*Primary Examiner* — Sevan A Aydin
(74) *Attorney, Agent, or Firm* — Studebaker & Brackett PC

(57) ABSTRACT

Toner contained in a toner container is used for replenishing a developing unit via an intermediate hopper. A toner sensor detects emptiness for the toner on an upstream side of a conveyance screw of the intermediate hopper in terms of the toner conveyance direction. Every time the toner sensor detects emptiness, the controller drives a rotation mechanism so that the toner is ejected from the toner container. Based on a drive history of a conveyance-purpose motor, the controller calculates a toner conveyance amount conveyed from the intermediate hopper between a time when the toner sensor detects emptiness and a time when the toner sensor detects emptiness again. When the calculated toner conveyance amount has been equal to or smaller than a first conveyance amount threshold value successively, the controller determines that the toner container is in a nearly empty state.

17 Claims, 15 Drawing Sheets

IMAGE FORMING APPARATUS

INCORPORATION BY REFERENCE

The present application claims priority under 35 U.S.C. § 119 to Japanese Patent Application No. 2018-140319, filed on Jul. 26, 2018. The contents of this application are incorporated herein by reference in their entirety.

BACKGROUND

The present disclosure is related to an image forming apparatus including a toner replenishing device that replenishes a developing unit with toner.

An image forming apparatus includes a toner container, an intermediate hopper, a developing unit, and a controller. The toner contained in the toner container is used for replenishing the developing unit via the intermediate hopper. The controller measures a time period between a time when the supply of the toner from the toner container to the intermediate hopper is started and a time when the remaining toner amount in the intermediate hopper reaches a prescribed amount. The controller estimates the remaining toner amount in the toner container based on the measured time period.

SUMMARY

An image forming apparatus according to an aspect of the present disclosure includes a developing unit, a toner container, an intermediate conveyance path, a first conveyance section, a second conveyance section, a first detector, and a controller. The developing unit develops an electrostatic image into a toner image. The toner container contains toner with which the developing unit is replenished. The toner is supplied from the toner container to the intermediate conveyance path. The first conveyance section conveys the toner from the toner container to the intermediate conveyance path. The second conveyance section conveys the toner from the intermediate conveyance path to the developing unit. The first detector detects emptiness for toner on the upstream side of the second conveyance section in terms of the toner conveyance direction. The controller controls the first conveyance section and the second conveyance section independently of each other. Every time the first detector detects emptiness, the controller drives the first conveyance section for a first driving time period. Based on a drive history of the second conveyance section, the controller calculates a toner conveyance amount conveyed from the intermediate conveyance path between a time when the first detector detects emptiness and a time when the first detector detects emptiness again. When the calculated toner conveyance amount has been equal to or smaller than a first conveyance amount threshold value successively, the controller determines that the toner container is in a nearly empty state.

Another image forming apparatus according to an aspect of the present disclosure includes a developing unit, a toner container, a conveyance section, a detector, and a controller. The developing unit develops an electrostatic latent image into a toner image. The toner container contains toner with which the developing unit is replenished. The conveyance section conveys the toner from the toner container to the developing unit. The detector detects concentration of the toner in the developing unit. The controller controls the conveyance section. Every time the detector detects that the concentration of the toner in the developing unit has decreased to a level equal to or smaller than a prescribed value, the controller drives the conveyance section for a first driving time period. The controller calculates, based on formation information of the electrostatic latent image, a toner conveyance amount conveyed from the toner container between a time when the detector detects a decrease in the concentration and a time when the detector detects a decrease in the concentration again. When the calculated toner conveyance amount has been equal to or smaller than a first conveyance amount threshold value successively, the controller determines that the toner container is in a nearly empty state.

DETAILED DESCRIPTION

Figure 1:
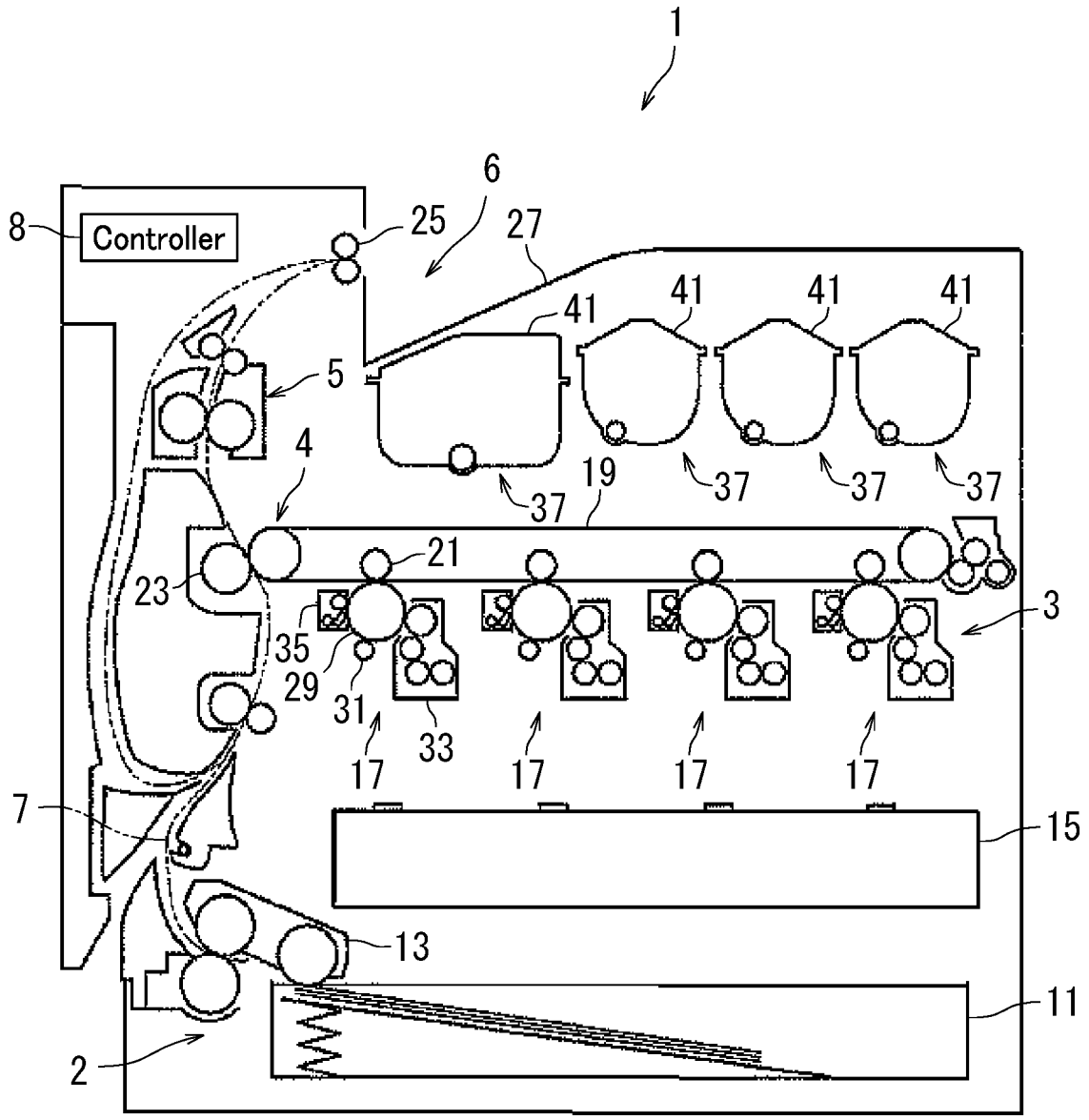
FIG. 1 is a diagram illustrating an example of an image forming apparatus according to a first embodiment.

The following describes embodiments of the present disclosure with reference to FIGS. 1 to 15. In the drawings, the same or equivalent elements are labeled with the same reference signs, and description thereof will not be repeated.

FIRST EMBODIMENT

Figure 2:
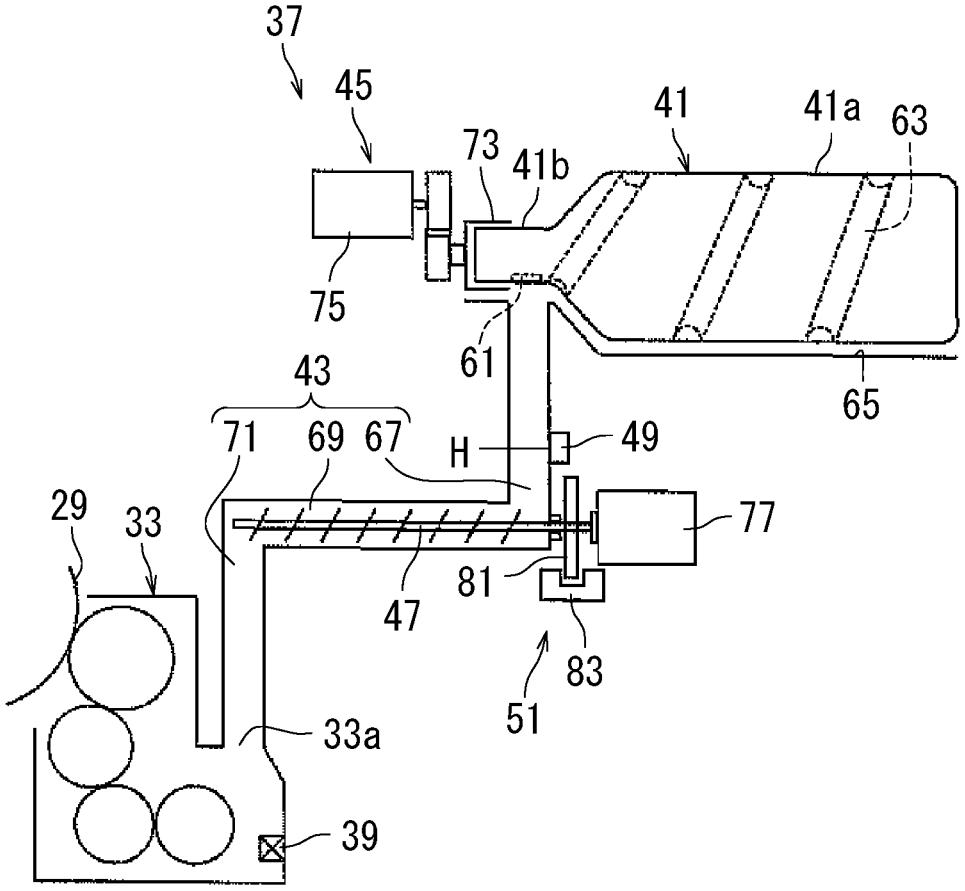
FIG. 2 is a diagram illustrating an example of a toner replenishing device according to the first embodiment.

First, an image forming apparatus 1 according to the first embodiment is described with reference to FIGS. 1 and 2. FIG. 1 is a drawing illustrating an example of the image forming apparatus 1 according to the first embodiment. FIG. 2 is a drawing illustrating an example of a toner replenishing device 37 according to the first embodiment. The image forming apparatus 1 functions as a color printer.

As illustrated in FIG. 1, the image forming apparatus 1 includes a paper feed section 2, a toner image forming section 3, a transfer section 4, a fixing device 5, a paper ejecting section 6, a paper conveyance path 7, and a controller 8.

The paper feed section 2 includes a paper feed cassette 11 containing paper and a paper feed device 13 that sends the paper from the paper feed cassette 11 onto the conveyance path 7.

The toner image forming section 3 includes an exposure device 15 and toner image forming units 17 provided in correspondence with four colors. The toner image forming section 3 forms toner images in each color. The four colors are yellow (Y), magenta (M), cyan (C), and black (B), for example.

The transfer section 4 includes an intermediate transfer belt 19, four primary transfer rollers 21, and a secondary transfer roller 23. The four primary transfer rollers 21 transfer, as a primary transfer, the toner images in the colors formed by the toner image forming section 3 onto the intermediate transfer belt 19. The secondary transfer roller 23 transfers, as a secondary transfer, the full-color toner image from the intermediate transfer belt 19 onto a sheet of paper.

The fixing device 5 fixes the full-color toner image resulting from the secondary transfer onto the sheet of paper.

The paper ejecting section 6 includes an ejecting device 25 and an exit tray 27. The ejecting device 25 ejects the sheet of paper on which the full-color toner image has been fixed. The exit tray 27 receives the ejected sheet of paper.

The conveyance path 7 extends from the paper feed section 2 and goes through the transfer section 4 and the fixing device 5, before reaching the paper ejecting section 6.

The controller 8 causes the paper feed section 2, the toner image forming section 3, the transfer section 4, the fixing device 5, and the paper ejecting section 6 to perform operations thereof and conveys the sheet of paper along the conveyance path 7 in accordance with the operations.

Next, the toner image forming units 17 are described. Each of the toner image forming units 17 includes a photosensitive drum 29, a charging device 31, a developing unit 33, and a cleaning device 35. The charging device 31, the developing unit 33, and the cleaning device 35 are arranged around the photosensitive drum 29. As illustrated in FIG. 2, each of the toner image forming units 17 further includes a toner replenishing device 37 that replenishes a corresponding one of the developing units 33 with the toner.

In each of the toner image forming units 17, the photosensitive drum 29 is electrically charged by the charging device 31 and is subsequently exposed to light by the exposure device 15 so as to form an electrostatic latent image. As illustrated in FIG. 2, each of the developing units 33 has a toner replenishment opening 33*a* and develops the electrostatic latent image into a toner image using the toner replenished by a corresponding one of the toner replenishing devices 37. Each of the developing units 33 further includes a toner concentration sensor 39 that detects a toner concentration level D in the developing unit 33. The toner concentration level D denotes a ratio of the toner in a two-component developer including the toner and a carrier. Each of the toner concentration sensors 39 is electrically connected to the controller 8 and transmits a detection result to the controller 8. Each of the cleaning devices 35 illustrated in FIG. 1 removes toner remaining on the photosensitive drum 29 after the toner image is transferred during the primary transfer onto the intermediate transfer belt 19. The toner concentration sensors 39 are equivalent to an example of a "second detector" and a "detector".

As illustrated in FIG. 2, each of the toner replenishing devices 37 includes a toner container 41, a toner container attachment and detachment section 65, an intermediate hopper 43, a rotation mechanism 45, a conveyance screw 47, a conveyance-purpose motor 77, a toner sensor 49, and a rotation detection mechanism 51.

The toner container 41 contains the toner with which a corresponding one of the developing units 33 is replenished. The toner container 41 has a bottle-like shape having an ejection opening 61. The toner container 41 has a main body section 41*a* having a circular cylindrical shape and a neck section 41*b* of which the diameter is smaller than that of the main body section 41*a*. On the inner circumferential surface of the main body section 41*a*, a ridge 63 projecting toward the interior of the main body section 41*a* is spirally formed. The ejection opening 61 is formed in a lateral face of the neck section 41*b*.

The toner container attachment and detachment section 65 attachably and detachably supports the toner container 41. The toner container 41 is attached to and detached from the toner container attachment and detachment section 65 while being in a sideway posture. As illustrated in FIG. 1, the toner containers 41 each corresponding to a different one of the four colors are installed in the image forming apparatus 1.

The toner is temporarily supplied from the toner container 41 to the intermediate hopper 43. The intermediate hopper 43 includes a retaining section 67, a horizontal conveyance section 69, and a vertical conveyance section 71. The retaining section 67 is positioned beneath the toner container 41 and extends in a vertical direction. One end of the horizontal conveyance section 69 communicates with the lower end of the retaining section 67 and extends in a horizontal direction. The vertical conveyance section 71 communicates with the other end of the horizontal conveyance section 69 and extends downwards in a vertical direction. The upper end opening of the retaining section 67 is connected to the toner container attachment and detachment section 65 while being positioned underneath the neck section 41*b* of the toner container 41. The lower end opening of the vertical conveyance section 71 is connected to the toner replenishment opening 33*a* of the developing unit 33. The intermediate hopper 43 is equivalent to an example of an "intermediate conveyance path".

The rotation mechanism 45 conveys the toner from the toner container 41 to the intermediate hopper 43. The rotation mechanism 45 includes a grip section 73 that grips the neck section 41*b* of the toner container 41 and a supply-purpose motor 75 that rotates the grip section 73. When the supply-purpose motor 75 rotates the grip section 73, the toner container 41 rotates. When the toner container 41 rotates, the toner contained in the main body section 41*a* is conveyed toward the neck section 41*b* by the spiral ridge 63 formed in the main body section 41*a*. When the ejection opening 61 formed in the neck section 41*b* faces downward, the toner falls into the retaining section 67 of the intermediate hopper 43 through the ejection opening 61. The supply-purpose motor 75 is electrically connected to the controller 8 and causes the toner container 41 to rotate at a constant rotation speed under the control of the controller 8. The rotation mechanism 45 is equivalent to an example of a "first conveyance section". The supply-purpose motor 75 is equivalent to an example of a "first motor".

The conveyance screw 47 conveys the toner from the intermediate hopper 43 to the developing unit 33. The conveyance screw 47 is rotatably supported by the horizontal conveyance section 69. As a result of the rotation of the conveyance screw 47, the toner inside the horizontal conveyance section 69 is conveyed toward the vertical conveyance section 71. The conveyance screw 47 is equivalent to an example of a "second conveyance section".

The conveyance-purpose motor 77 is electrically connected to the controller 8 and causes the conveyance screw 47 to rotate at a constant rotation speed as driven by the controller 8. The conveyance-purpose motor 77 is equivalent to an example of a "second conveyance section" and a "second motor".

On the upstream side of the conveyance screw 47 in terms of the toner conveyance direction, the toner sensor 49 detects emptiness for the toner. The toner sensor 49 is provided in a lower part of the retaining section 67 of the intermediate hopper 43. When the upper surface of the toner retained in the horizontal conveyance section 69 and the retaining section 67 has decreased to a detection height H, the toner sensor 49 detects the emptiness. A transmissive or reflective photo sensor, a piezoelectric sensor, or the like may be used as the toner sensor 49. The toner sensor 49 is electrically connected to the controller 8 and transmits a detection result indicating whether or not emptiness has been detected to the controller 8. The toner sensor 49 is equivalent to an example of a "first detector".

The rotation detection mechanism 51 includes a pulse plate 81 and a transmissive photo sensor 83 fixed at one end of the conveyance screw 47. The pulse plate 81 has formed therein a plurality of slits that are arranged at regular intervals in the circumferential direction. The transmissive photo sensor 83 includes a light emitting section and a light receiving section that face each other while the pulse plate 81 is interposed therebetween. When any of the slits of the pulse plate 81 passes through an optical path provided between the light emitting section and the light receiving section, the transmissive photo sensor 83 outputs a pulse waveform. The transmissive photo sensor 83 is electrically connected to the controller 8. The controller 8 is able to calculate the number of times of rotation (hereinafter "rotation number") of the conveyance screw 47 by counting the pulse waveform output from the transmissive photo sensor 83.

Figure 3:
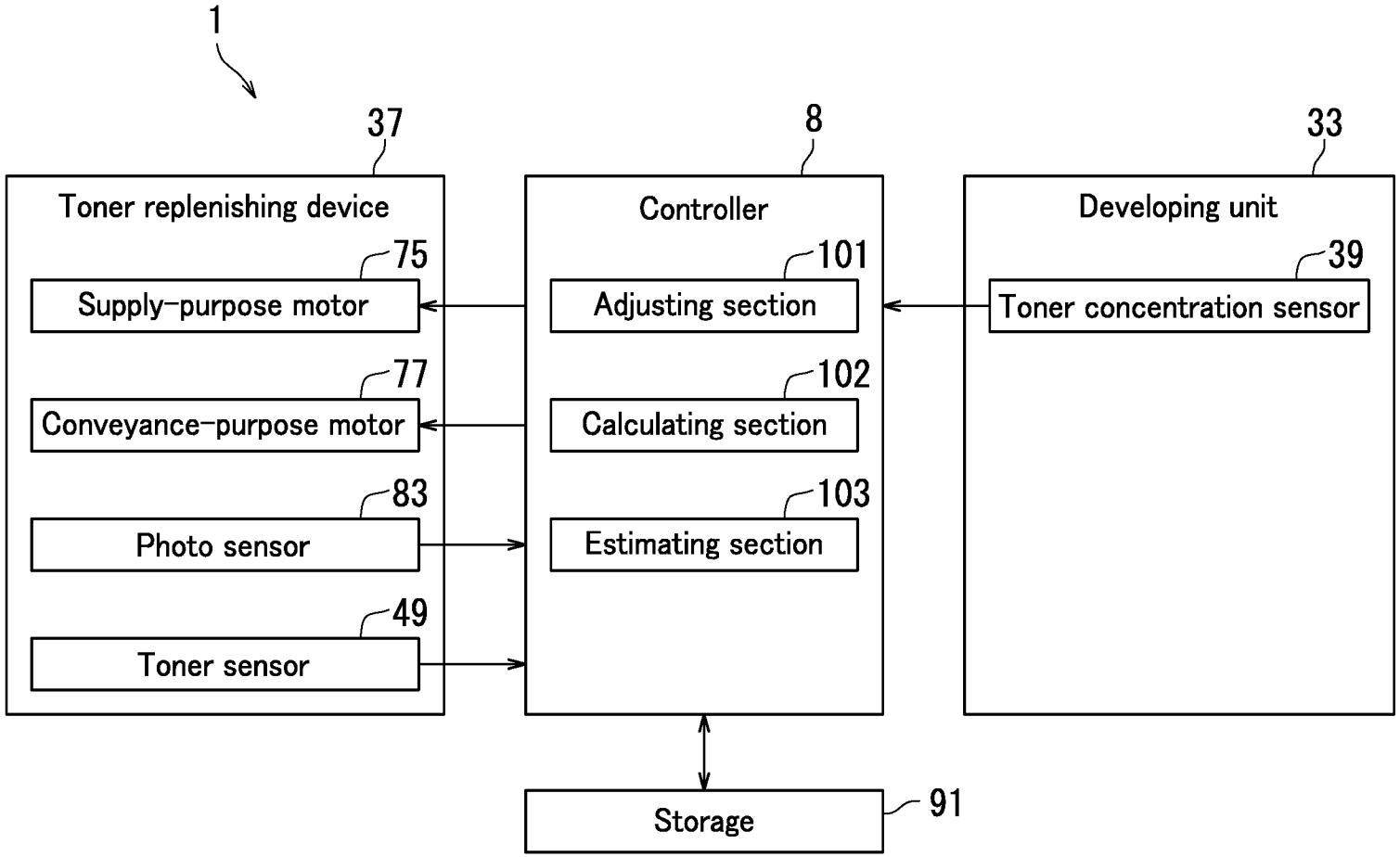
FIG. 3 is a diagram illustrating an example of a controller according to the first embodiment.

Next, the controller 8 according to the first embodiment is described. FIG. 3 is a diagram illustrating an example of the controller 8.

As illustrated in FIG. 3, the image forming apparatus 1 includes storage 91, in addition to the controller 8. The controller 8 includes a processor such as a Central Processing Unit (CPU). The storage 91 includes storage devices and stores therein data and at least one computer program. The storage 91 includes a main storage device such as semiconductor memory and one or more auxiliary storage devices such as either or both of semiconductor memory and a hard disk drive. The processor of the controller 8 controls constituent elements of the image forming apparatus 1 by executing the computer program stored in any of the storage devices in the storage 91.

As described above, each of the toner replenishing devices 37 includes the supply-purpose motor 75, the conveyance-purpose motor 77, the transmissive photo sensor 83, and the toner sensor 49. Further, each of the developing units 33 includes the toner concentration sensor 39. The controller 8 includes an adjusting section 101, a calculating section 102, and an estimating section 103. The processor of the controller 8 is electrically connected to the supply-purpose motors 75, the conveyance-purpose motors 77, the transmissive photo sensors 83, the toner sensors 49, and the toner concentration sensors 39, and functions as the adjusting section 101, the calculating section 102, and the estimating section 103.

The adjusting section 101 adjusts the toner concentration level D in each of the developing units 33 by driving a corresponding one of the conveyance-purpose motors 77 based on the detection result obtained by a corresponding one of the toner concentration sensors 39. The toner concentration level D needs to be kept at a constant level. However, when the toner in any of the developing units 33 is consumed, the toner concentration level D decreases. Thus, when the toner concentration level D becomes equal to or smaller than a threshold value TD1, the adjusting section 101 drives the conveyance-purpose motor 77 and causes the conveyance screw 47 to rotate so that the toner is conveyed from the intermediate hopper 43 to the developing unit 33. As a result, the toner concentration level D is kept at a substantially constant level.

Based on a drive history of each of the conveyance-purpose motors 77, the calculating section 102 calculates a toner conveyance amount Y conveyed from a corresponding one of the intermediate hoppers 43 between a time when the toner sensor 49 detects emptiness and a time when the toner sensor 49 detects emptiness again. As the drive history of the conveyance-purpose motor 77, the rotation number of the conveyance-purpose motor 77, or the rotation number of the conveyance screw 47 is used. The rotation number of the conveyance-purpose motor 77 is obtained as a result of the calculating section 102 counting the pulse waveforms output from the transmissive photo sensor 83. The toner conveyance amount per rotation of the conveyance screw 47 is substantially constant. Based on the rotation number of the conveyance screw 47 between the time when the toner sensor 49 detects emptiness and the time when the toner sensor 49 detects emptiness again, the calculating section 102 calculates the toner conveyance amount Y in that time period.

Based on of the calculated toner conveyance amount Y, the estimating section 103 estimates a remaining toner amount (%) X in the toner container 41.

Figure 4:
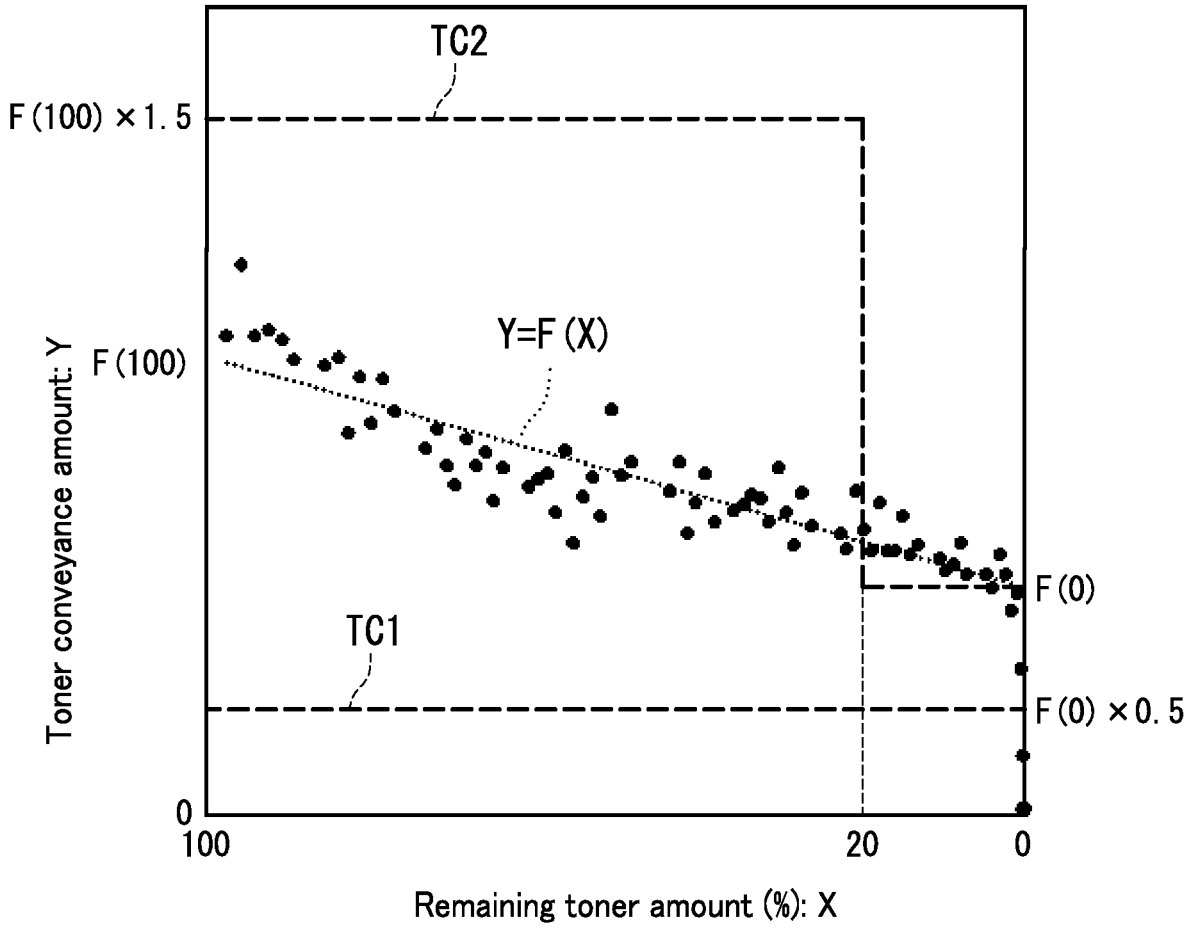
FIG. 4 is a diagram illustrating an example of a relationship between a remaining toner amount in a toner container and a toner conveyance amount to a developing unit.
Figure 5:
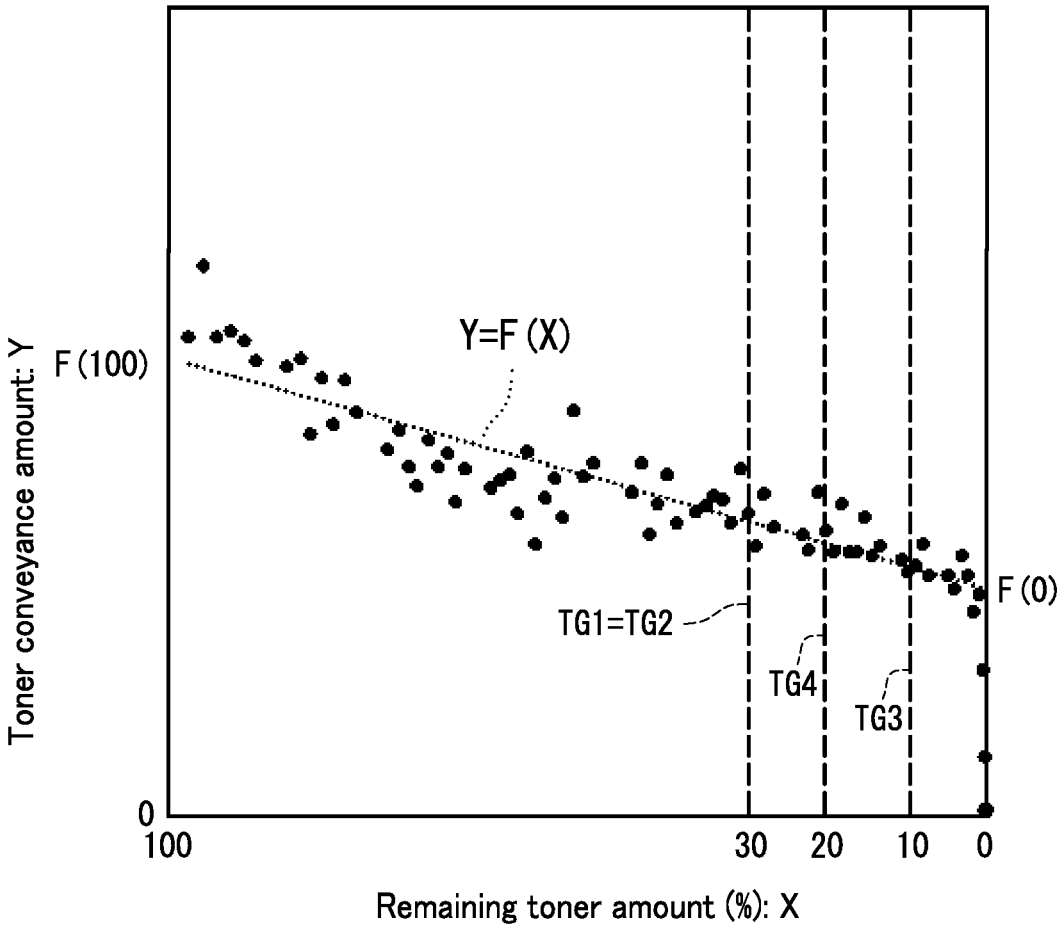
FIG. 5 is a diagram illustrating an example of the relationship between the remaining toner amount in the toner container and the toner conveyance amount to the developing unit.

FIGS. 4 and 5 are drawings illustrating examples of a relationship between the remaining toner amount X and the toner conveyance amount Y. In FIGS. 4 and 5, the horizontal axis expresses the remaining toner amount X, whereas the vertical axis expresses the toner conveyance amount Y. The large number of dots in FIGS. 4 and 5 represent results of experiments indicating the relationship between the remaining toner amount X and the toner conveyance amount Y. From the results of the experiments, a regression curve Y=F(X) is obtained. The regression curve Y=F(X) indicates that the toner conveyance amount Y decreases as the remaining toner amount X decreases. The estimating section 103 in FIG. 3 estimates a remaining toner amount X based on a toner conveyance amount Y using the regression curve Y=F(X). Based on the estimated remaining toner amount X, the controller 8 presents the user with a toner gauge.

In FIGS. 4 and 5, a value F(0) and a value F(100) are defined. The value F(0) is obtained by extrapolating the regression curve Y=F(X) into X=0%. The value F(100) is obtained by extrapolating the regression curve Y=F(X) into X=100%.

In FIG. 4, a first conveyance amount threshold value TC1 and a second conveyance amount threshold value TC2 are set. The first conveyance amount threshold value TC1 is set to a value smaller than the value F(0). For example, TC1=F(0)×0.5. Further, for the range of X>20%, TC2=F(100)×1.5. For the range of X≤20%, TC2=F(0).

In FIG. 5, a first gauge threshold value TG1, a second gauge threshold value TG2, a third gauge threshold value TG3, and a fourth gauge threshold value TG4 are set. For example, the threshold values are set as follows: TG1=30%; TG2=30%; TG3=10%; and TG4=20%. Note that it is possible for TG1>TG2.

Figure 6:
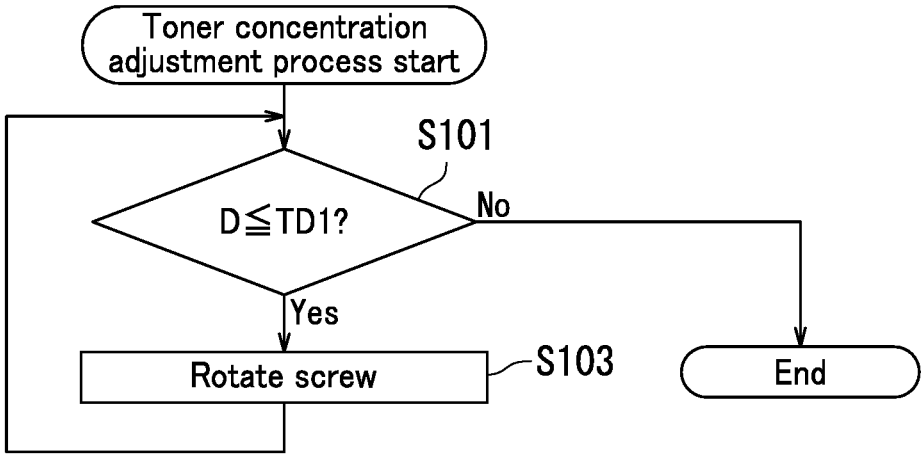
FIG. 6 is a flowchart depicting an example of processes performed by the controller.

Next, processes performed by the controller 8 are described with reference to FIGS. 6 to 10. FIG. 6 is a flowchart illustrating an example of a toner concentration adjustment process performed by the controller 8. The toner concentration adjustment process is performed in Steps S101 through S103.

Step S101: The controller 8 determines whether or not the toner concentration level D detected by the toner concentration sensor 39 is equal to or smaller than the threshold value TD1. When the controller 8 determines that the toner concentration level D is equal to or smaller than the threshold value TD1 (Step S101: YES), the process performed by the controller 8 proceeds to Step S103. When the controller 8 determines that the toner concentration level D is not equal to or smaller than the threshold value TD1, (Step S101: NO), the process performed by the controller 8 ends.

Step S103: The controller 8 drives the conveyance-purpose motor 77 for a prescribed period of time so as to rotate the conveyance screw 47. As a result, a substantially constant amount of toner is conveyed from the intermediate hopper 43 to the developing unit 33. After that, the process performed by the controller 8 returns to Step S101.

During the toner concentration adjustment process in Steps S101 through S103, the controller 8 controls the conveyance-purpose motor 77 based on the detection result obtained by the toner concentration sensor 39. As a result, the toner concentration level D in the developing unit 33 is kept at a substantially constant level.

Figure 7:
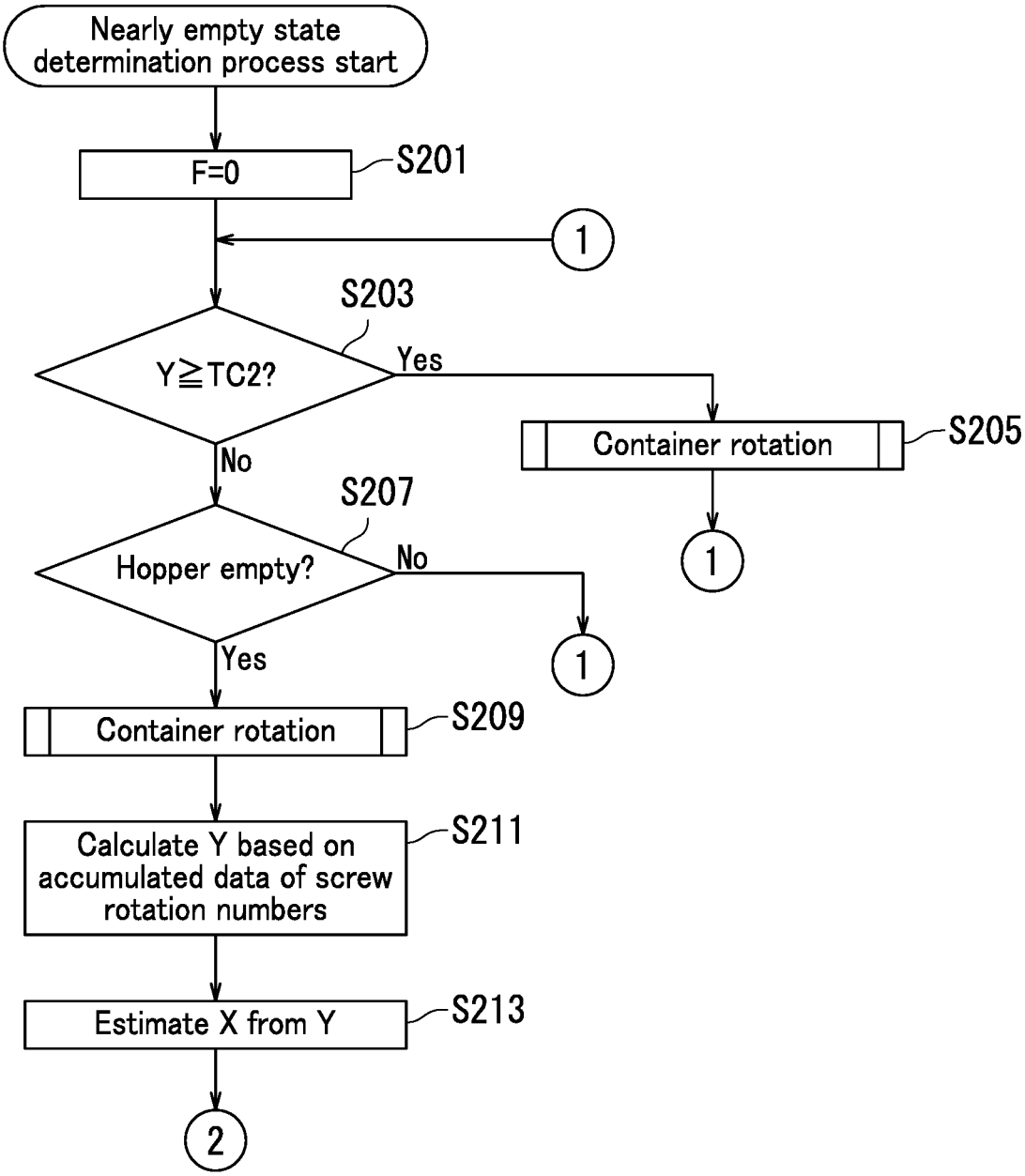
FIG. 7 is a flowchart depicting an example of processes performed by the controller.
Figure 8:
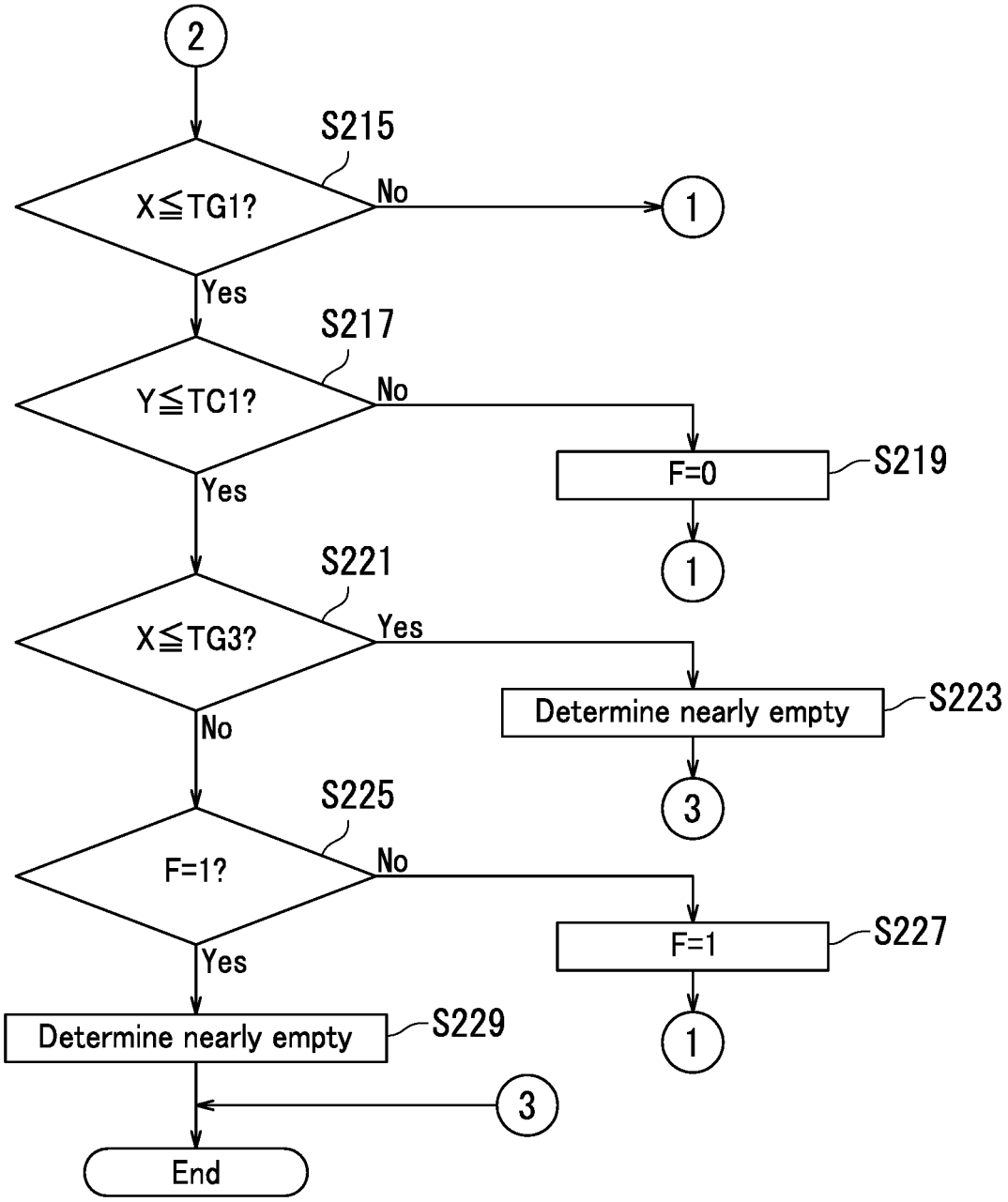
FIG. 8 is a flowchart depicting an example of processes performed by the controller.

FIGS. 7 and 8 are flowcharts illustrating an example of a nearly empty state determination process performed by the controller 8. The nearly empty state determination process is performed in Steps S201 through S229.

Step S201: The controller 8 sets a flag F to 0. The flag F is a flag used for confirming whether or not a specific event has occurred successively.

Step S203: The controller 8 determines whether or not the toner conveyance amount Y is equal to or larger than the second conveyance amount threshold value TC2.

When the controller 8 determines that the toner conveyance amount Y is equal to or larger than the second conveyance amount threshold value TC2 (Step S203: YES), the process performed by the controller 8 proceeds to Step S205. When the controller 8 determines that the toner conveyance amount Y is not equal to or larger than the second conveyance amount threshold value TC2 (Step S203: NO), the process performed by the controller 8 proceeds to Step S207.

Step S205: The controller 8 calls a container rotation subroutine, which is described later with reference to FIG. 10, so as to rotate the toner container 41. More specifically, the controller 8 drives the supply-purpose motor 75 for a first driving time period. When the process in Step S205 is finished, the process performed by the controller 8 returns to Step S203.

Step S207: Based on the detection result obtained by the toner sensor 49, the controller 8 determines whether or not the intermediate hopper 43 is empty. When the controller 8 determines that the intermediate hopper 43 is not empty (Step S207: NO), the process performed by the controller 8 returns to Step S203. When the controller 8 determines that the intermediate hopper 43 is empty (Step S207: YES), the process performed by the controller 8 proceeds to Step S209.

Step S209: The controller 8 calls the container rotation subroutine so as to rotate the toner container 41. More specifically, the controller 8 drives the supply-purpose motor 75 for the first driving timer period. When the process in Step S209 is finished, the process performed by the controller 8 proceeds to Step S211.

Step S211: The controller 8 calculates a toner conveyance amount Y based on accumulated data of the screw rotation numbers. When the process in Step S211 is finished, the process performed by the controller 8 proceeds to Step S213.

Step S213: The controller 8 estimates a remaining toner amount X based on the toner conveyance amount Y. When the process in Step S213 is finished, the process performed by the controller 8 proceeds to Step S215 in FIG. 8.

Step S215: The controller 8 determines whether or not the remaining toner amount X is equal to or smaller than the first gauge threshold value TG1. When the controller 8 determines that the remaining toner amount X is not equal to or smaller than the first gauge threshold value TG1 (Step S215: NO), the process performed by the controller 8 returns to Step S203. When the controller 8 determines that the remaining toner amount X is equal to or smaller than the first gauge threshold value TG1 (Step S215: YES), the process performed by the controller 8 proceeds to Step S217.

Step S217: The controller 8 determines whether or not the toner conveyance amount Y is equal to or smaller than the first conveyance amount threshold value TC1. When the controller 8 determines that the toner conveyance amount Y is not equal to or smaller than the first conveyance amount threshold value TC1 (Step S217: NO), the process performed by the controller 8 proceeds to Step S219. When the controller 8 determines that the toner conveyance amount Y is equal to or smaller than the first conveyance amount threshold value TC1 (Step S217: YES), the process performed by the controller 8 proceeds to Step S221.

Step S219: The controller 8 sets the flag F to 0. When the process in Step S219 is finished, the process performed by the controller 8 returns to Step S203.

Step S221: The controller 8 determines whether or not the remaining toner amount X is equal to or smaller than the third gauge threshold value TG3. When the controller 8 determines that the remaining toner amount X is equal to or smaller than the third gauge threshold value TG3 (Step S221: YES), the process performed by the controller 8 proceeds to Step S223. When the controller 8 determines that the remaining toner amount X is not equal to or smaller than the third gauge threshold value TG3 (Step S221: NO), the process performed by the controller 8 proceeds to Step S225.

Step S223: The controller 8 determines that the toner container 41 is in a nearly empty state. When the process in Step S223 is finished, the nearly empty state determination process performed by the controller 8 ends.

Step S225: The controller 8 determines whether or not the flag F is 1. When the controller 8 determines that the flag F is not 1 (Step S225: NO), the process performed by the controller 8 proceeds to Step S227. When the controller 8 determines that the flag F is 1 (Step S225: YES), the process performed by the controller 8 proceeds to Step S229.

Step S227: The controller 8 sets the flag F to 1. When the process in Step S227 is finished, the process performed by the controller 8 returns to Step S203.

Step S229: The controller 8 determines that the toner container 41 is in a nearly empty state. When the process in Step S229 is finished, the nearly empty state determination process performed by the controller 8 ends.

During the nearly empty state determination process in Steps S201 through S229, the controller 8 drives the supply-purpose motor 75 for the first driving time period, every time the toner sensor 49 detects emptiness (Step S209 in FIG. 7). Further, based on the drive history of the conveyance-purpose motor 77, the controller 8 calculates the toner conveyance amount Y conveyed from the intermediate hopper 43 between the time when the toner sensor 49 detects emptiness and the time when the toner sensor 49 detects emptiness again (Step S211). Further, when the calculated toner conveyance amount Y has been equal to or smaller than the first conveyance amount threshold value TC1 twice successively, the controller 8 determines that the toner container 41 is in a nearly empty state (Step S229 in FIG. 8).

As the remaining toner amount X decreases, the toner ejection amount from the toner container 41 decreases. As the toner ejection amount decreases, the time intervals at which the toner sensor 49 detects emptiness become shorter. In the first embodiment, the controller 8 performs the nearly empty state determination process on the toner container 41, by utilizing the shortening of the time intervals at which the emptiness is detected. Accordingly, when the toner container 41 starts being used, it is possible to prevent the toner in the toner container 41 from aggregating, while preventing the toner from being supplied excessively. Further, at stages after the toner keeps being consumed, it is possible to reduce the remaining toner amount X observed when emptiness is detected, while preventing the replenishment from the toner container 41 from being delayed. In this manner, the controller 8 performs the nearly empty state determination process for the toner container 41 with appropriate timing.

When the remaining toner amount X becomes a few percent (%), it is known that the toner conveyance amount Y decreases rapidly. The toner conveyance amount Y varies depending on conveyance capability of the toner container 41 and the shape and the capacity of the intermediate hopper 43. Accordingly, although the first conveyance amount threshold value TC1 is not particularly limited, it is desirable to set the first conveyance amount threshold value TC1 to a small value, so as to avoid the variance range of the toner conveyance amount Y observed until the remaining toner amount X becomes a few percent.

Further, during the nearly empty state determination process in Steps S201 through S229, the controller 8 estimates the remaining toner amount X in the toner container 41 based on the calculated toner conveyance amount Y (Step S213 in FIG. 7). Further, in a case where the estimated remaining toner amount X is equal to or smaller than the first gauge threshold value TG1, the controller 8 determines that the toner container 41 is in a nearly empty state when the calculated toner conveyance amount Y has been equal to or smaller than the first conveyance amount threshold value TC1 twice successively (Step S229 in FIG. 8).

The reason why the first gauge threshold value TG1 is set is so that it is possible to avoid erroneously determining that the toner container 41 is in a "nearly empty state" when the toner in the toner container 41 is lightly aggregating while in storage, for example. In particular, when the toner container 41 starts being used, the toner may not easily be ejected from the toner container 41. When the toner conveyance amount Y significantly decreases before the remaining toner amount X becomes equal to or smaller than the first gauge threshold value TG1, it is desirable to configure the controller 8 to perform a special ejection sequence for an ejection from the toner container 41. As another example, it is desirable to configure the controller 8 to display a message for the user to suggest taking out and shaking the toner container 41.

Further, during the nearly empty state determination process in Steps S201 through S229, the controller 8 drives the supply-purpose motor 75 for the first driving time period when the calculated toner conveyance amount Y is equal to or larger than the second conveyance amount threshold value TC2 (Step S205 in FIG. 7). The driving of the supply-purpose motor 75 in Step S205 is performed even when the toner sensor 49 does not detect emptiness. As illustrated in FIG. 4, the second conveyance amount threshold value TC2 is set in such a manner that, before and after X=20%, the value of TC2 decreases as the remaining toner amount X in the toner container 41 decreases.

At the initial stage of use of the toner container 41, because the remaining toner amount X is large, the ejection amount from the toner container 41 is large. Accordingly, the amount of the toner retained in the intermediate hopper 43 as a result of driving the toner container 41 for the prescribed period of time is large. As a result, it is not necessary to drive the toner container 41 frequently, and the driving time period can be short. Conversely, in a case where the toner container 41 is frequently driven for a long period of time, the toner is compressed in the intermediate hopper 43, and the fluidity of the toner becomes degraded. To avoid this situation, while the remaining toner amount X is large, the second conveyance amount threshold value TC2 is set to larger values. This arrangement increases the possibility of the determination result in Step S203 in FIG. 7 being "NO". As a result, the control (Step S207 and thereafter) using the detection result obtained by the toner sensor 49 is primarily performed.

As the remaining toner amount X decreases while the toner keeps being consumed, the ejection amount from the toner container 41 decreases. Accordingly, the amount of the toner retained in the intermediate hopper 43 as a result of driving the toner container 41 for the prescribed period of time decreases. In a case where the toner consumption amount of the developing unit 33 increases after the toner amount in the intermediate hopper 43 has decreased, various problems arise such as a delayed supply of toner from the toner container 41 and insufficiency of toner in the intermediate hopper 43. To avoid these situations, when the remaining toner amount X is small, the second conveyance amount threshold value TC2 is set to the smaller values. This arrangement increases the possibility of the determination result in Step S203 in FIG. 7 being "YES". Accordingly, the toner container 41 is forcibly rotated regardless of whether or not the toner sensor 49 has detected emptiness (Step S205). As a result, the remaining toner amount X observed upon detection of emptiness of the toner container 41 is reduced.

Further, during the nearly empty state determination process in Steps S201 through S229, the controller 8 determines that the toner container 41 is in a nearly empty state when the estimated remaining toner amount X is equal to or smaller than the third gauge threshold value TG3 (Step S223 in FIG. 8). The determination of the nearly empty state in Step S223 is made, even when the calculated toner conveyance amount Y has not been equal to or smaller than the first conveyance amount threshold value TC1 successively.

It is possible to improve the reliability of the nearly empty state determination process by determining a nearly empty state while using one selected from between: a first method by which it is determined whether or not the calculated toner conveyance amount Y has been equal to or smaller than the first conveyance amount threshold value TC1 twice successively; and a second method by which it is determined whether or not the estimated remaining toner amount X is equal to or smaller than the third gauge threshold value TG3. Of the two methods, the first method by which the nearly empty state is determined when the calculated toner conveyance amount Y has been equal to or smaller than the first conveyance amount threshold value TC1 twice successively is suitable for situations where the remaining number of sheets of paper that can be printed with the toner container 41 is approximately in the range of 100 sheets to 500 sheets. The second method by which the nearly empty state is determined when the estimated remaining toner amount X is equal to or smaller than the third gauge threshold value TG3 is suitable for situations where the remaining number of sheets of paper that can be printed with the toner container 41 is approximately 500 sheets or more.

Figure 9:
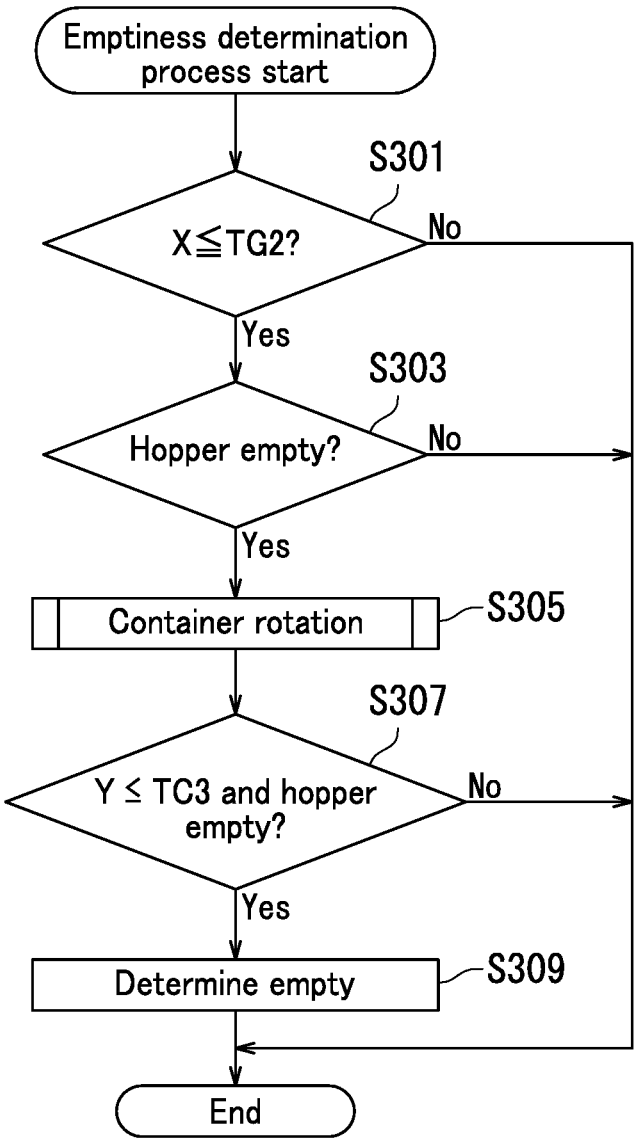
FIG. 9 is a flowchart depicting an example of processes performed by the controller.

FIG. 9 is a flowchart illustrating an example of an emptiness determination process performed by the controller 8. The emptiness determination process is performed in Steps S301 through S309.

Step S301: The controller 8 determines whether or not the remaining toner amount X is equal to or smaller than the second gauge threshold value TG2. When the controller 8 determines that the remaining toner amount X is not equal to or smaller than the second gauge threshold value TG2 (Step S301: NO), the emptiness determination process performed by the controller 8 ends. When the controller 8 determines that the remaining toner amount X is equal to or smaller than the second gauge threshold value TG2 (Step S301: YES), the process performed by the controller 8 proceeds to Step S303.

Step S303: Based on a detection result obtained by the toner sensor 49, the controller 8 determines whether or not the intermediate hopper 43 is empty. When the controller 8 determines that the intermediate hopper 43 is not empty (Step S303: NO), the emptiness determination process performed by the controller 8 ends. When the controller 8 determines that the intermediate hopper 43 is empty (Step S303: YES), the process performed by the controller 8 proceeds to Step S305.

Step S305: The controller 8 calls the container rotation subroutine (described later) so as to rotate the toner container 41. More specifically, the controller 8 drives the supply-purpose motor 75 for a second driving time period. When the process in Step S305 is finished, the process performed by the controller 8 proceeds to Step S307.

Step S307: The controller 8 determines whether or not the toner conveyance amount Y is equal to or smaller than the third conveyance amount threshold value TC3, while the intermediate hopper 43 is empty. When the controller 8 determines that the toner conveyance amount Y is not equal to or smaller than the third conveyance amount threshold value TC3 or when the controller 8 determines that the intermediate hopper 43 is not empty (Step S307: NO), the emptiness determination process performed by the controller 8 ends. When the controller 8 determines that the toner conveyance amount Y is equal to or smaller than the third conveyance amount threshold value TC3, while the intermediate hopper 43 is empty (Step S307: YES), the process performed by the controller 8 proceeds to Step S309.

Step S309: The controller 8 determines that the toner container 41 is empty. When the process in Step S309 is finished, the emptiness determination process performed by the controller 8 ends.

During the emptiness determination process in Steps S301 through S309, the controller 8 determines that the toner container 41 is empty when the remaining toner amount X is equal to or smaller than the second gauge threshold value TG2. The condition is satisfied when, even after the supply-purpose motor 75 is driven for the second driving time period upon detection of emptiness by the toner sensor 49, the toner conveyance amount Y is still equal to or smaller than the third conveyance amount threshold value TC3, while the detection of emptiness by the toner sensor 49 has not yet been resolved.

Figure 10:
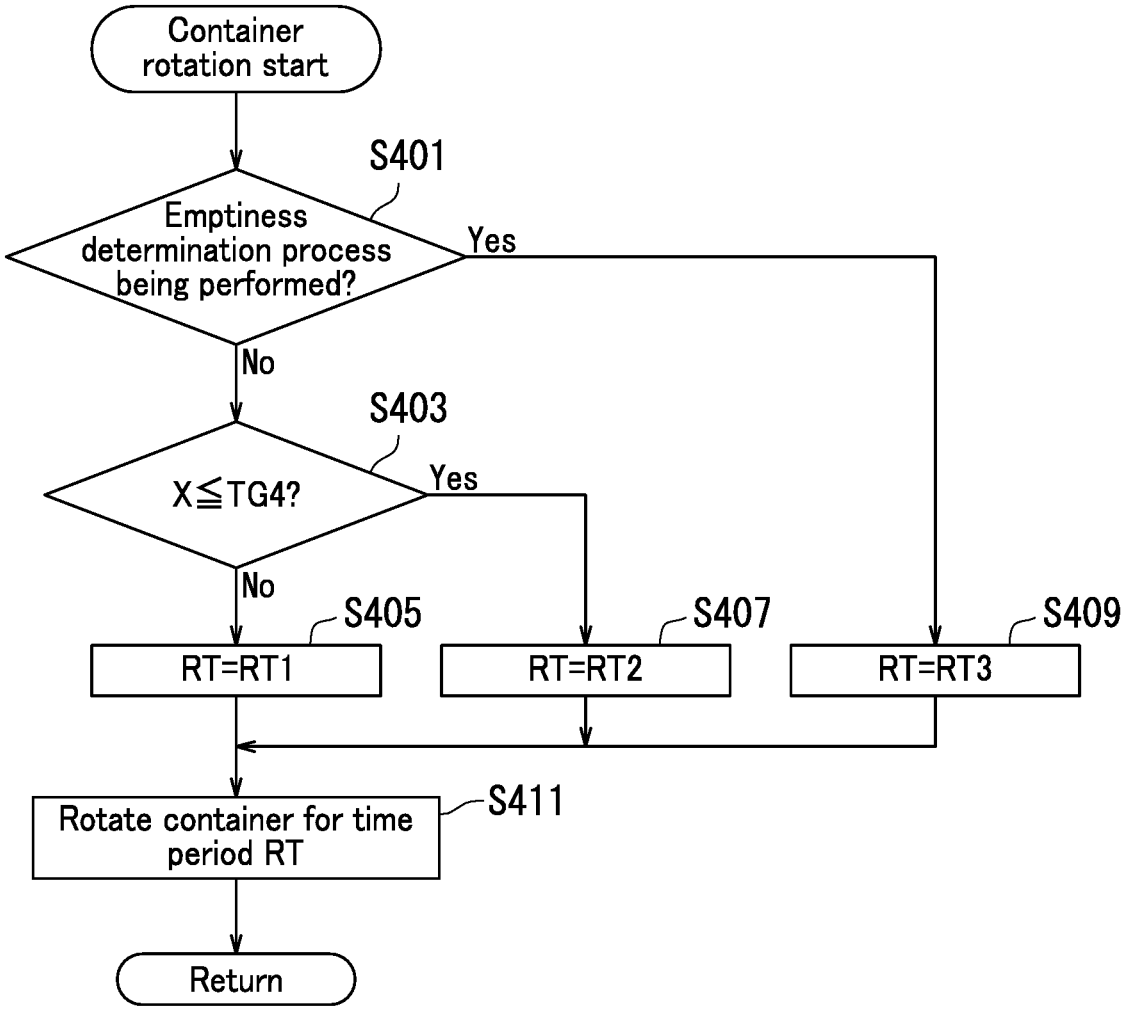
FIG. 10 is a flowchart depicting an example of processes performed by the controller.

FIG. 10 is a flowchart illustrating an example of the process in the container rotation subroutine performed by the controller 8. The container rotation subroutine is performed in Steps S401 through S411.

Step S401: The controller 8 determines whether or not the emptiness determination process described with reference to FIG. 9 is currently being performed. When the controller 8 determines that the emptiness determination process is currently being performed (Step S401: YES), the process performed by the controller 8 proceeds to Step S409. When the controller 8 determines that the emptiness determination process is not currently being performed (Step S401: NO), the process performed by the controller 8 proceeds to Step S403.

Step S403: The controller 8 determines whether or not the remaining toner amount X is equal to or smaller than the fourth gauge threshold value TG4. When the controller 8 determines that the remaining toner amount X is equal to or smaller than the fourth gauge threshold value TG4 (Step S403: YES), the process performed by the controller 8 proceeds to Step S407. When the controller 8 determines that the remaining toner amount X is not equal to or smaller than the fourth gauge threshold value TG4 (Step S403: NO), the process performed by the controller 8 proceeds to Step S405.

Step S405: The controller 8 sets a rotation time period RT of the toner container 41 to be a first rotation time period RT1. The first rotation time period RT1 is, for example, 3 seconds or longer and is shorter than 7 seconds. When the process in Step S405 is finished, the process performed by the controller 8 proceeds to Step S411.

Step S407: The controller 8 sets the rotation time period RT of the toner container 41 to be a second rotation time period RT2. The second rotation time period RT2 is, for example, 7 seconds or longer and is shorter than 15 seconds. When the process in Step S407 is finished, the process performed by the controller 8 proceeds to Step S411.

Step S409: The controller 8 sets the rotation time period RT of the toner container 41 to be a third rotation time period RT3. The third rotation time period RT3 is, for example, 15 seconds or longer. When the process in Step S409 is finished, the process performed by the controller 8 proceeds to Step S411.

Step S411: The controller 8 rotates the toner container 41 by driving the supply-purpose motor 75 for the rotation time period RT. When the process in Step S411 is finished, the container rotation subroutine performed by the controller 8 ends.

In the process of the container rotation subroutine in Steps S401 through S411, the driving time period (the first driving time period) of the supply-purpose motor 75 during the nearly empty state determination process is arranged to be either the first rotation time period RT1 or the second rotation time period RT2. Further, the driving time period (the second driving time period) of the supply-purpose motor 75 during the emptiness determination process is arranged to be the third rotation time period RT3. The first driving time period is set in such a manner that, before and after the fourth gauge threshold value TG4, the first driving time period becomes longer as the remaining toner amount X decreases. This arrangement reduces the remaining toner amount X observed when emptiness of the toner container 41 is detected. Further, to make it possible to eject even a small amount of remaining toner in the toner container 41, the second driving time period is set to be longer than the first driving time period.

SECOND EMBODIMENT

Figure 11:
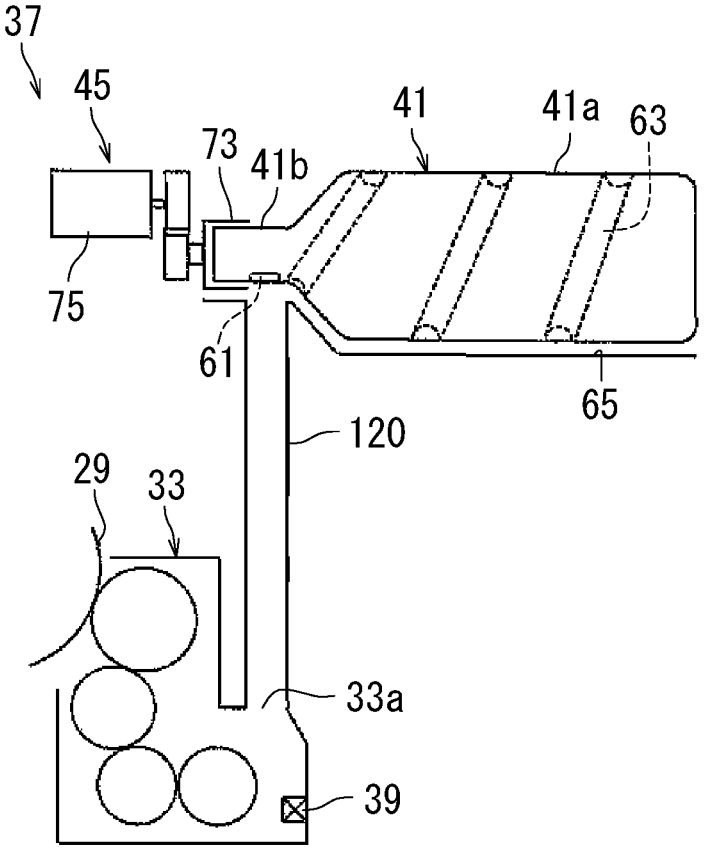
FIG. 11 is a diagram illustrating an example of the toner replenishing device according to a second embodiment.

Next, the image forming apparatus 1 according to a second embodiment is described. Because the overall configuration of the image forming apparatus 1 is the same as that illustrated in FIG. 1, description thereof is omitted. FIG. 11 is a drawing illustrating an example of the toner replenishing device 37 according to the second embodiment.

In the second embodiment, the toner replenishing device 37 is different from that in the first embodiment for not including the intermediate hopper 43, the conveyance screw 47, the conveyance-purpose motor 77, the toner sensor 49, and the rotation detection mechanism 51, while including a vertical conveyance section 120.

The toner container 41 illustrated in FIG. 11 contains the toner with which a corresponding one of the developing units 33 is replenished. The toner container 41 has a bottle-like shape having the ejection opening 61. The toner container 41 has the main body section 41*a* having a circular cylindrical shape and the neck section 41*b* of which the diameter is smaller than that of the main body section 41*a*. On the inner circumferential surface of the main body section 41*a*, the ridge 63 projecting toward the interior of the main body section 41*a* is spirally formed. The ejection opening 61 is formed in the lateral face of the neck section 41*b*.

The toner container attachment and detachment section 65 supports the toner container 41 while allowing detachment and re-attachment. The toner container 41 is attached to and detached from the toner container attachment and detachment section 65 while being in a sideway posture. As illustrated in FIG. 1, the toner containers 41 each corresponding to a different one of the four colors are installed in the image forming apparatus 1.

The vertical conveyance section 120 extends in a vertical direction between the toner container attachment and detachment section 65 and the developing unit 33. The upper end opening of the vertical conveyance section 120 is connected to the toner container attachment and detachment section 65 while being positioned underneath the neck section 41*b* of the toner container 41. The lower end opening of the vertical conveyance section 120 is connected to the toner replenishment opening 33*a* of the developing unit 33.

The rotation mechanism 45 conveys the toner from the toner container 41 to the developing unit 33. The rotation mechanism 45 includes the grip section 73 that grips the neck section 41*b* of the toner container 41 and the supply-purpose motor 75 that rotates the grip section 73. When the supply-purpose motor 75 rotates the grip section 73, the toner container 41 rotates. When the toner container 41 rotates, the toner contained in the main body section 41*a* is conveyed toward the neck section 41*b* by the spiral ridge 63 formed in the main body section 41*a*. When the ejection opening 61 formed in the neck section 41*b* faces downward, the toner falls into the developing unit 33 through the ejection opening 61. The supply-purpose motor 75 is electrically connected to the controller 8 and causes the toner container 41 to rotate at a constant rotation speed under the control of the controller 8. The rotation mechanism 45 is equivalent to an example of a "conveyance section". The supply-purpose motor 75 is equivalent to an example of a "motor".

Figure 12:
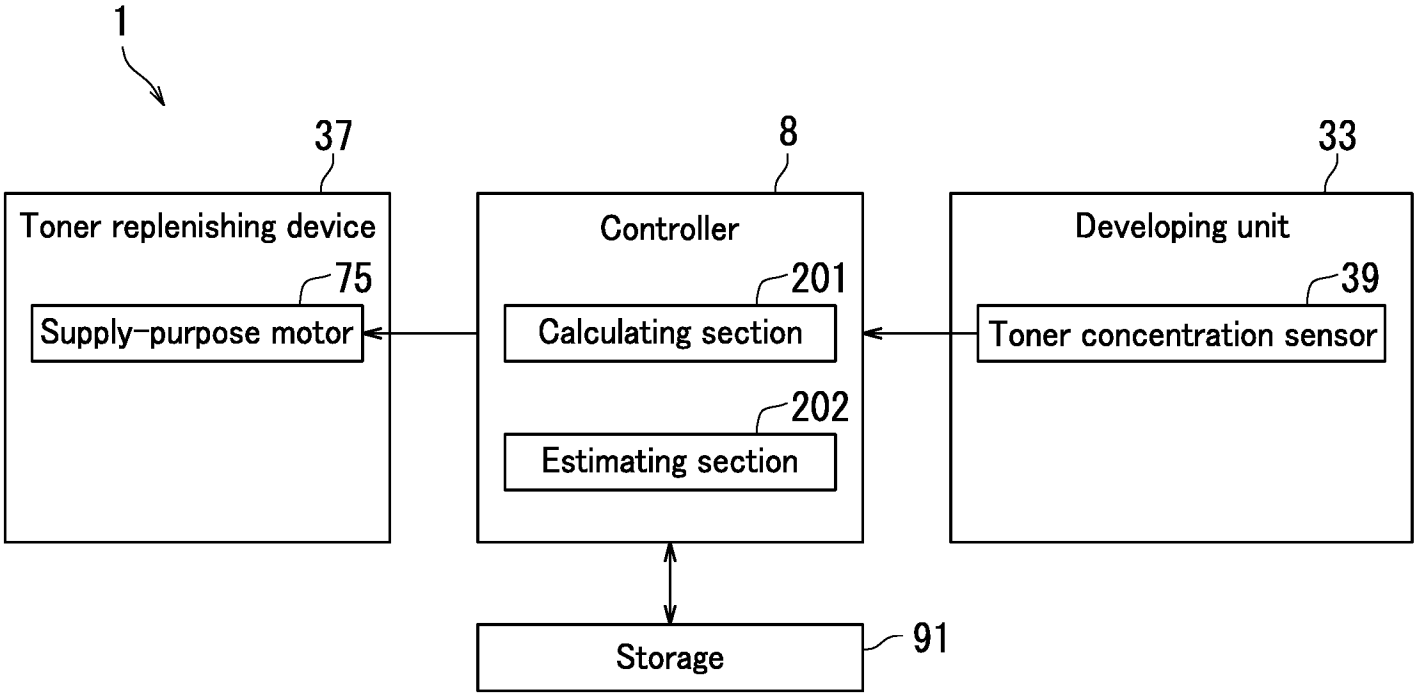
FIG. 12 is a diagram illustrating an example of the controller according to the second embodiment.

Next, the controller 8 according to the second embodiment is described. FIG. 12 is a diagram illustrating an example of the controller 8.

As illustrated in FIG. 12, the image forming apparatus 1 includes the storage 91 in addition to the controller 8. The controller 8 includes a processor such as a central processing unit (CPU). The storage 91 includes storage devices and stores therein data and at least one computer program. The storage 91 includes a main storage device such as a semiconductor memory and one or more auxiliary storage devices such as either or both of semiconductor memory and a hard disk drive. The processor of the controller 8 controls constituent elements of the image forming apparatus 1 by executing the computer program stored in any of the storage devices of the storage 91.

As described above, each of the toner replenishing devices 37 includes the supply-purpose motor 75. Further, each of the developing units 33 includes the toner concentration sensor 39. The controller 8 includes a calculating section 201 and an estimating section 202. The processor of the controller 8 is electrically connected to the supply-purpose motors 75 and to the toner concentration sensors 39 and functions as the calculating section 201 and the estimating section 202.

Based on formation information of the electrostatic latent image (for example accumulated data of printing rates), the calculating section 201 calculates a toner conveyance amount Y conveyed from the toner container 41 between a time when the toner concentration sensor 39 detects a decrease in the toner concentration level D and a time when the toner concentration sensor 39 detects a decrease in the toner concentration level D again.

Based on the calculated toner conveyance amount Y, the estimating section 202 estimates a remaining toner amount X (%) of the toner in the toner container 41.

The explanations provided with reference to FIGS. 4 and 5 are also applicable to the controller 8 according to the second embodiment; however, the toner conveyance amount Y is the amount of the toner conveyed from the toner container 41 between the time when the toner concentration sensor 39 detects a decrease in the toner concentration level D and the time when the toner concentration sensor 39 detects a decrease in the toner concentration level D again.

Figure 13:
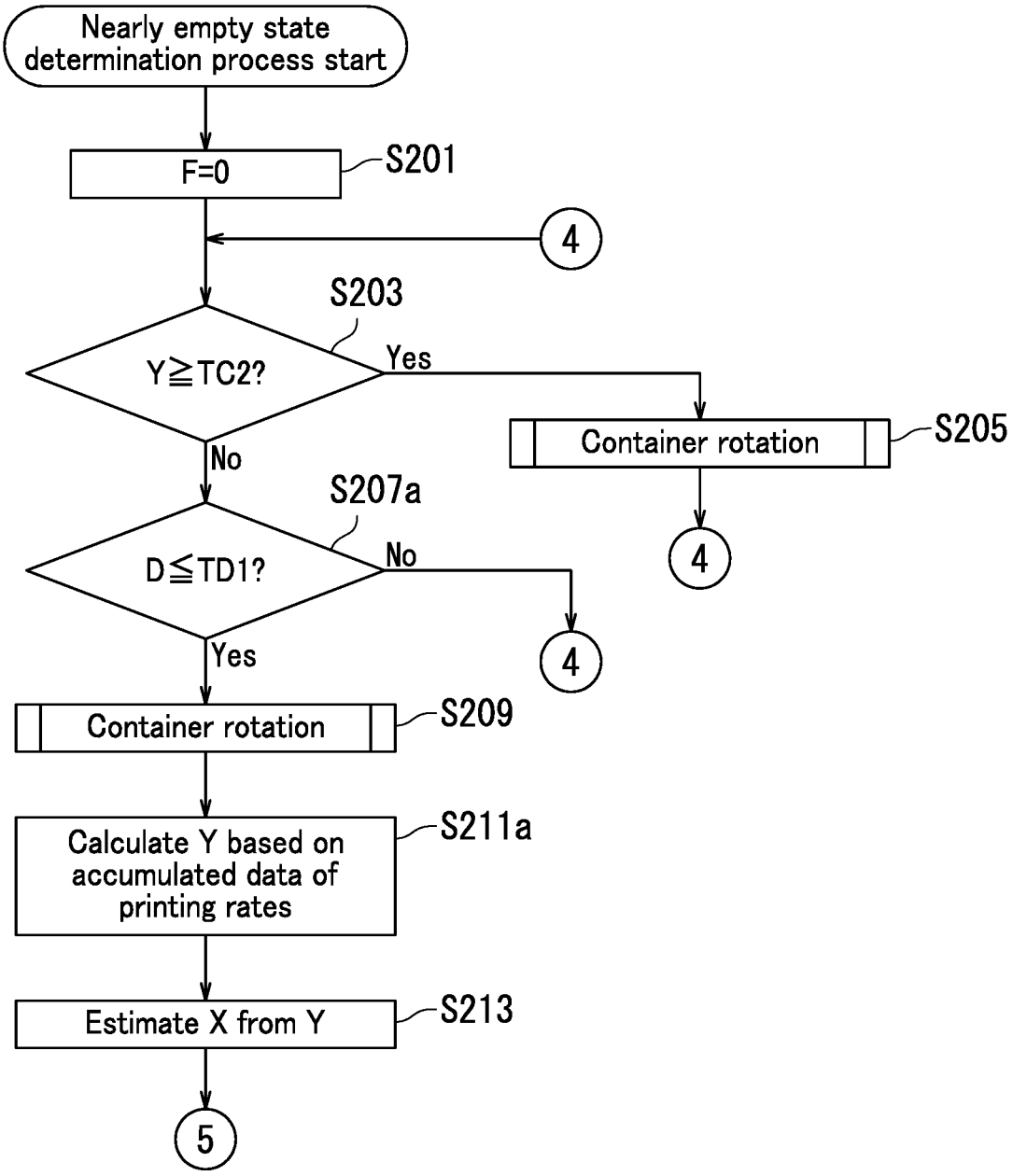
FIG. 13 is a flowchart depicting an example of processes performed by the controller.
Figure 14:
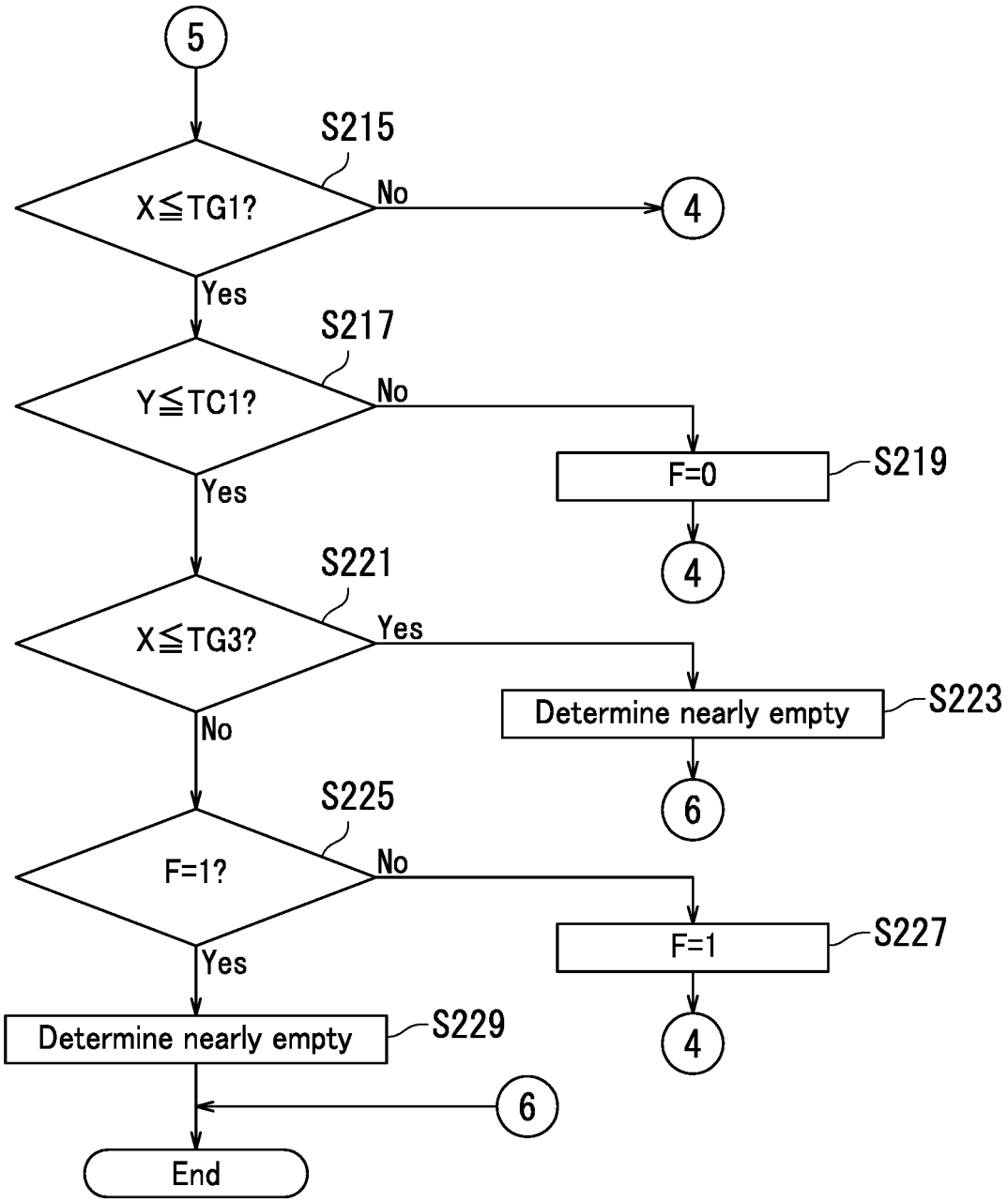
FIG. 14 is a flowchart depicting an example of processes performed by the controller.

Next, processes performed by the controller 8 are described with reference to FIGS. 13 to 15. FIGS. 13 and 14 are flowcharts illustrating an example of a nearly empty state determination process performed by the controller 8. The nearly empty state determination process is performed in Steps S201 through S229.

Step S201: The controller 8 sets the flag F to 0. The flag F is a flag used for confirming whether or not a specific event has occurred successively.

Step S203: The controller 8 determines whether or not the toner conveyance amount Y is equal to or larger than the second conveyance amount threshold value TC2. When the controller 8 determines that the toner conveyance amount Y is equal to or larger than the second conveyance amount threshold value TC2 (Step S203: YES), the process performed by the controller 8 proceeds to Step S205. When the controller 8 determines that the toner conveyance amount Y is not equal to or larger than the second conveyance amount threshold value TC2 (Step S203: NO), the process performed by the controller 8 proceeds to Step S207*a*.

Step S205: The controller 8 calls the container rotation subroutine, which is described above with reference to FIG. 10, so as to rotate the toner container 41. More specifically, the controller 8 drives the supply-purpose motor 75 for the first driving time period. When the process in Step S205 is finished, the process performed by the controller 8 returns to Step S203.

Step S207*a*: The controller 8 determines whether or not the toner concentration level D detected by the toner concentration sensor 39 is equal to or smaller than the threshold value TD1. When the controller 8 determines that the toner concentration level D is not equal to or smaller than the threshold value TD1, (Step S207*a*: NO), the process performed by the controller 8 returns to Step S203. When the controller 8 determines that the toner concentration level D is equal to or smaller than the threshold value TD1 (Step S207*a*: YES), the process performed by the controller 8 proceeds to Step S209.

Step S209: The controller 8 calls the container rotation subroutine so as to rotate the toner container 41. More specifically, the controller 8 drives the supply-purpose motor 75 for the first driving timer period. When the process in Step S209 is finished, the process performed by the controller 8 proceeds to Step S211*a*.

Step S211*a*: The controller 8 calculates a toner conveyance amount Y based on the accumulated data of the printing rates. When the process in Step S211*a* is finished, the process performed by the controller 8 proceeds to Step S213.

Step S213: The controller 8 estimates the remaining toner amount X based on the toner conveyance amount Y. When the process in Step S213 is finished, the process performed by the controller 8 proceeds to Step S215 in FIG. 14.

Step S215: The controller 8 determines whether or not the remaining toner amount X is equal to or smaller than the first gauge threshold value TG1. When the controller 8 determines that the remaining toner amount X is not equal to or smaller than the first gauge threshold value TG1 (Step S215: NO), the process performed by the controller 8 returns to Step S203. When the controller 8 determines that the remaining toner amount X is equal to or smaller than the first gauge threshold value TG1 (Step S215: YES), the process performed by the controller 8 proceeds to Step S217.

Step S217: The controller 8 determines whether or not the toner conveyance amount Y is equal to or smaller than the first conveyance amount threshold value TC1. When the controller 8 determines that the toner conveyance amount Y is not equal to or smaller than the first conveyance amount threshold value TC1 (Step S217: NO), the process performed by the controller 8 proceeds to Step S219. When the controller 8 determines that the toner conveyance amount Y is equal to or smaller than the first conveyance amount threshold value TC1 (Step S217: YES), the process performed by the controller 8 proceeds to Step S221.

Step S219: The controller 8 sets the flag F to 0. When the process in Step S219 is finished, the process performed by the controller 8 returns to Step S203.

Step S221: The controller 8 determines whether or not the remaining toner amount X is equal to or smaller than the third gauge threshold value TG3. When the controller 8 determines that the remaining toner amount X is equal to or smaller than the third gauge threshold value TG3 (Step S221: YES), the process performed by the controller 8 proceeds to Step S223. When the controller 8 determines that the remaining toner amount X is not equal to or smaller than the third gauge threshold value TG3 (Step S221: NO), the process performed by the controller 8 proceeds to Step S225.

Step S223: The controller 8 determines that the toner container 41 is in a nearly empty state. When the process in Step S223 is finished, the nearly empty state determination process performed by the controller 8 ends.

Step S225: The controller 8 determines whether or not the flag F is 1. When the controller 8 determines that the flag F is not 1 (Step S225: NO), the process performed by the controller 8 proceeds to Step S227. When the controller 8 determines that the flag F is 1 (Step S225: YES), the process performed by the controller 8 proceeds to Step S229.

Step S227: The controller 8 sets the flag F to 1. When the process in Step S227 is finished, the process performed by the controller 8 returns to Step S203.

Step S229: The controller 8 determines that the toner container 41 is in a nearly empty state. When the process in Step S229 is finished, the nearly empty state determination process performed by the controller 8 ends.

During the nearly empty state determination process in Steps S201 through S229, the controller 8 drives the supply-purpose motor 75 for the first driving time period, every time the toner concentration sensor 39 detects that the toner concentration level D in the developing unit 33 has decreased to a level equal to or smaller than the threshold value TD1 (Step S209 in FIG. 13). Further, based on the formation information of the electrostatic latent image, the controller 8 calculates the toner conveyance amount Y conveyed from the toner container 41 between the time when the toner concentration sensor 39 detects a decrease in the concentration level D and the time when the toner concentration sensor 39 detects a decrease in the concentration level D again (Step S211*a*). Further, when the calculated toner conveyance amount Y has been equal to or smaller than the first conveyance amount threshold value TC1 twice successively, the controller 8 determines that the toner container 41 is in a nearly empty state (Step S229 in FIG. 14).

As the remaining toner amount X decreases, the toner ejection amount from the toner container 41 decreases. As the toner ejection amount decreases, the time intervals at which the toner concentration sensor 39 detects a decrease in the toner concentration level D become shorter. In the second embodiment, the controller 8 performs the nearly empty state determination process on the toner container 41, by utilizing the shortening of the time intervals at which a decrease in the toner concentration level D is detected. Accordingly, when the toner container 41 starts being used, it is possible to prevent the toner in the toner container 41 from aggregating while preventing the toner from being supplied excessively. Further, at stages after the toner keeps being consumed, it is possible to reduce the remaining toner amount X observed when emptiness is detected, while preventing the replenishment from the toner container 41 from being delayed. In this manner, the controller 8 performs the nearly empty state determination process for the toner container 41 with appropriate timing.

When the remaining toner amount X becomes a few percent (%), it is known that the toner conveyance amount Y decreases rapidly. The toner conveyance amount Y varies depending on conveyance capability of the toner container 41. Accordingly, although the first conveyance amount threshold value TC1 is not particularly limited, it is desirable to set the first conveyance amount threshold value TC1 to a small value so as to avoid the variance range of the toner conveyance amount Y observed until the remaining toner amount X becomes a few percent.

Further, during the nearly empty state determination process in Steps S201 through S229, the controller 8 estimates the remaining toner amount X in the toner container 41 based on the calculated toner conveyance amount Y (Step S213 in FIG. 13). Further, when the estimated remaining toner amount X is equal to or smaller than the first gauge threshold value TG1, the controller 8 determines that the toner container 41 is in a nearly empty state when the calculated toner conveyance amount Y has been equal to or smaller than the first conveyance amount threshold value TC1 twice successively (Step S229 in FIG. 14).

The reason why the first gauge threshold value TG1 is set is so that it is possible to avoid erroneously determining that the toner container 41 is in a "nearly empty state" when the toner in the toner container 41 is lightly aggregating while in storage, for example. In particular, when the toner container 41 starts being used, the toner may not easily be ejected from the toner container 41. When the toner conveyance amount Y significantly decreases before the remaining toner amount X becomes equal to or smaller than the first gauge threshold value TG1, it is desirable to configure the controller 8 to perform a special ejection sequence for an ejection from the toner container 41. As another example, it is desirable to configure the controller 8 to display a message for the user to suggest taking out and shaking the toner container 41.

Further, during the nearly empty state determination process in Steps S201 through S229, the controller 8 drives the supply-purpose motor 75 for the first driving time period when the calculated toner conveyance amount Y is equal to or larger than the second conveyance amount threshold value TC2 (Step S205 in FIG. 13). The driving of the supply-purpose motor 75 in Step S205 is performed even when the toner concentration sensor 39 does not detect any decrease in the toner concentration level D. As illustrated in FIG. 4, the second conveyance amount threshold value TC2 is set in such a manner that, before and after X=20%, the value of TC2 decreases as the remaining toner amount X in the toner container 41 decreases.

At the initial stage of use of the toner container 41, because the remaining toner amount X is large, the ejection amount from the toner container 41 is large. Accordingly, the amount of the toner supplied to the developing unit 33 as a result of driving the toner container 41 for the prescribed period of time is large. As a result, it is not necessary to drive the toner container 41 frequently, and the driving time period can be short. Consequently, when the remaining toner amount X is large, the second conveyance amount threshold value TC2 is set to larger values. This arrangement increases the possibility of the determination result in Step S203 in FIG. 13 being "NO". As a result, the control (Step S207*a* and thereafter) using the detection result obtained by the toner concentration sensor 39 is primarily exercised.

As the remaining toner amount X decreases while the toner keeps being consumed, the ejection amount from the toner container 41 decreases. Accordingly, the amount of the toner supplied to the developing unit 33 as a result of driving the toner container 41 for the prescribed period of time decreases. In a case where the toner consumption amount of the developing unit 33 increases after the amount of the toner supplied to the developing unit 33 has decreased, a problem such as a delayed supply of toner from the toner container 41 arises. To avoid this situation, when the remaining toner amount X is small, the second conveyance amount threshold value TC2 is set to the smaller values. This arrangement increases the possibility of the determination result in Step S203 in FIG. 13 being "YES". Accordingly, the toner container 41 is forcibly rotated regardless of whether or not the toner concentration sensor 39 has detected a decrease in the toner concentration level D (Step S205 in FIG. 13). As a result, the remaining toner amount X observed upon detection of emptiness of the toner container 41 is reduced.

Further, during the nearly empty state determination process in Steps S201 through S229, the controller 8 determines that the toner container 41 is in a nearly empty state when the estimated remaining toner amount X is equal to or smaller than the third gauge threshold value TG3 (Step S223 in FIG. 14). The determination of the nearly empty state in Step S223 is made even when the calculated toner conveyance amount Y has not been equal to or smaller than the first conveyance amount threshold value TC1 successively.

It is possible to improve the reliability of the nearly empty state determination process by determining a nearly empty state while using one selected from between: the first method by which it is determined whether or not the calculated toner conveyance amount Y has been equal to or smaller than the first conveyance amount threshold value TC1 twice successively; and the second method by which it is determined whether or not the estimated remaining toner amount X is equal to or smaller than the third gauge threshold value TG3. Of the two methods, the first method by which the nearly empty state is determined when the calculated toner conveyance amount Y has been equal to or smaller than the first conveyance amount threshold value TC1 twice successively is suitable for situations where the remaining number of sheets of paper that can be printed with the toner container 41 is approximately in the range of 100 sheets to 500 sheets. The second method by which the nearly empty state is determined when the estimated remaining toner amount X is equal to or smaller than the third gauge threshold value TG3 is suitable for situations where the remaining number of sheets of paper that can be printed with the toner container 41 is approximately 500 sheets or more.

Figure 15:
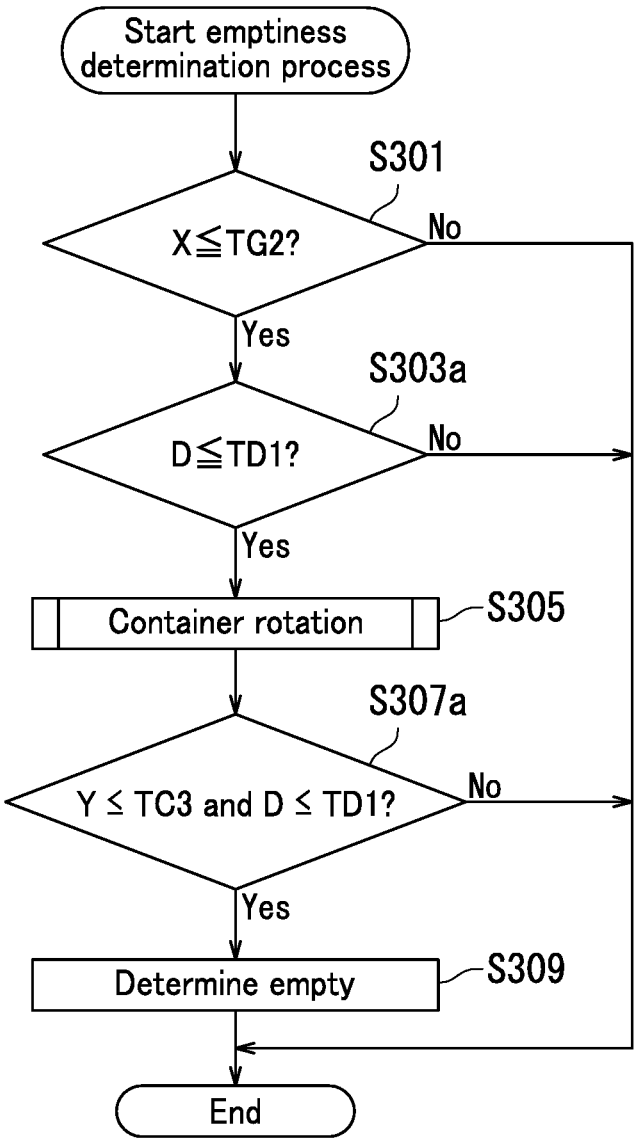
FIG. 15 is a flowchart depicting an example of processes performed by the controller.

FIG. 15 is a flowchart illustrating an example of the emptiness determination process performed by the controller 8. The emptiness determination process is performed in Steps S301 through S309.

Step S301: The controller 8 determines whether or not the remaining toner amount X is equal to or smaller than the second gauge threshold value TG2. When the controller 8 determines that the remaining toner amount X is not equal to or smaller than the second gauge threshold value TG2 (Step S301: NO), the emptiness determination process performed by the controller 8 ends. When the controller 8 determines that the remaining toner amount X is equal to or smaller than the second gauge threshold value TG2 (Step S301: YES), the process performed by the controller 8 proceeds to Step S303*a*.

Step S303*a*: The controller 8 determines whether or not the toner concentration level D detected by the toner concentration sensor 39 is equal to or smaller than the threshold value TD1. When the controller 8 determines that the toner concentration level D is not equal to or smaller than the threshold value TD1 (Step S303*a*: NO), the emptiness determination process performed by the controller 8 ends. When the controller 8 determines that the toner concentration level D is equal to or smaller than the threshold value TD1 (Step S303*a*: YES), the process performed by the controller 8 proceeds to Step S305.

Step S305: The controller 8 calls the container rotation subroutine so as to rotate the toner container 41. More specifically, the controller 8 drives the supply-purpose motor 75 for the second driving time period. When the process in Step S305 is finished, the process performed by the controller 8 proceeds to Step S307*a*.

Step S307*a*: The controller 8 determines whether or not the toner conveyance amount Y is equal to or smaller than the third conveyance amount threshold value TC3, while the toner concentration level D is equal to or smaller than the threshold value TD1. When the controller 8 determines that the toner conveyance amount Y is not equal to or smaller than the third conveyance amount threshold value TC3 or when the controller 8 determines that the toner concentration level D is not equal to or smaller than the threshold value TD1 (Step S307*a*: NO), the emptiness determination process performed by the controller 8 ends. When the controller 8 determines that the toner conveyance amount Y is equal to or smaller than the third conveyance amount threshold value TC3, while the toner concentration level D is equal to or smaller than the threshold value TD1 (Step S307*a*: YES), the process performed by the controller 8 proceeds to Step S309.

Step S309: The controller 8 determines that the toner container 41 is empty. When the process in Step S309 is finished, the emptiness determination process performed by the controller 8 ends.

During the emptiness determination process in Steps S301 through S309, the controller 8 determines that the toner container 41 is empty, when the remaining toner amount X is equal to or smaller than the second gauge threshold value TG2. The condition is satisfied when, even after the supply-purpose motor 75 is driven for the second driving time period upon detection of a decrease in the concentration level D by the toner concentration sensor 39, the toner conveyance amount Y is still equal to or smaller than the third conveyance amount threshold value TC3, while the detection of the decrease in the concentration level D by the toner concentration sensor 39 has not yet been resolved.

Further, as described with reference to FIG. 10, in the process of the container rotation subroutine performed by the controller 8 (Steps S401 through S411 in FIG. 10), the driving time period (the first driving time period) of the supply-purpose motor 75 during the nearly empty state determination process is arranged to be either the first rotation time period RT1 or the second rotation time period RT2. Further, the driving time period (the second driving time period) of the supply-purpose motor 75 during the emptiness determination process is arranged to be the third rotation time period RT3. The first driving time period is set in such a manner that, before and after the fourth gauge threshold value TG4, the first driving time period becomes longer as the remaining toner amount X decreases. This arrangement reduces the remaining toner amount X observed when emptiness of the toner container 41 is detected. Further, to make it possible to eject even a small amount of remaining toner in the toner container 41, the second driving time period is set to be longer than the first driving time period.

The description of the above embodiments describes preferred embodiments of the present disclosure and therefore includes, in some situations, various limitations that are technically desirable. However, unless a particular limitation to the present disclosure is noted, the technical scope of the present disclosure is not limited to the modes described above. In other words, the constituent elements in the above embodiments may be replaced by existing constituent elements or the like, as appropriate. It is also possible to use any of variations obtained by combining the described constituent elements with other existing constituent elements. The description of the embodiments presented above does not limit the scope of the disclosure defined in the claims.

(1) In the first embodiment, the rotation detection mechanism 51 includes the pulse plate 81 and the transmissive photo sensor 83. The controller 8 calculates the rotation number of the conveyance-purpose motor 77 by counting the pulse waveforms output from the transmissive photo sensor 83. Alternatively, it is also acceptable to use a stepping motor as the conveyance-purpose motor 77 and to exercise pulse control over the stepping motor. Further, driving time periods of the conveyance-purpose motor 77 may be accumulated.

(2) In the first embodiment, the controller 8 controls the supply-purpose motor 75 and the conveyance-purpose motor 77 independently of each other; however, during printing processes, other situations are also possible where the conveyance-purpose motor 77 constantly rotates or where the supply-purpose motor 75 and the conveyance-purpose motor 77 rotate in conjunction with each other. In these possible situations, it is thought that the toner container 41 and the intermediate hopper 43 constitute a single toner container, while the supply-purpose motor 75 and the conveyance-purpose motor 77 constitute a single toner conveyance section. To these structures, it is possible to apply the nearly empty state determination process using the toner concentration sensor 39 and the like, which is described as the second embodiment.

(3) In the second embodiment, the controller 8 calculates the toner conveyance amount Y based on the accumulated data of the printing rates. Alternatively, the controller 8 may calculate the toner conveyance amount Y based on a drive history of the rotation mechanism 45.

(4) In the first and the second embodiments, the number of toner containers 41 rotated by each single supply-purpose motor 75 is one. Alternatively, the number of toner containers 41 rotated by each single supply-purpose motor 75 may be two or more. In that situation, it is possible to decrease the quantity of the supply-purpose motors 75 and to reduce the costs. Although each of the toner replenishing devices 37 determines the rotation time period RT of a corresponding one of the supply-purpose motors 75, the toner containers 41 shall be rotated so as to accommodate the longest rotation time period RT. As a result, it is possible to avoid the situation where the toner supply amount from any of the toner containers 41 to a corresponding one of the intermediate hoppers 43 becomes insufficient or where the toner supply amount from any of the toner containers 41 to a corresponding one of the developing units 33 becomes insufficient.

What is claimed is:

1. An image forming apparatus comprising:

a developing unit configured to develop an electrostatic latent image into a toner image;

a toner container containing toner with which the developing unit is replenished;

an intermediate conveyance path to which the toner is supplied from the toner container;

a first conveyance section configured to convey the toner from the toner container to the intermediate conveyance path;

a second conveyance section configured to convey the toner from the intermediate conveyance path to the developing unit;

a first detector configured to detect emptiness for toner on an upstream side of the second conveyance section in terms of a toner conveyance direction; and a controller configured to control the first conveyance section and the second conveyance section independently of each other; wherein every time the first detector detects emptiness, the controller drives the first conveyance section for a first driving time period, based on a drive history of the second conveyance section, the controller calculates a toner conveyance amount conveyed from the intermediate conveyance path between a time when the first detector detects emptiness and a time when the first detector detects emptiness again, and when the calculated toner conveyance amount has been equal to or smaller than a first conveyance amount threshold value successively, the controller determines that the toner container is in a nearly empty state.

2. The image forming apparatus according to claim 1, wherein the first conveyance amount threshold value is smaller than a value F(0) indicating a result of extrapolating a regression curve Y=F(X) into X=0%, and the regression curve Y=F(X) indicates a relationship between a remaining toner amount X in the toner container and a toner conveyance amount Y conveyed from the intermediate conveyance path between the time when the first detector detects emptiness and the time when the first detector detects emptiness again.

3. The image forming apparatus according to claim 1, wherein the controller estimates a remaining toner amount in the toner container based on the calculated toner conveyance amount, and in a case where the estimated remaining toner amount is equal to or smaller than a first gauge threshold value, the controller determines that the toner container is in the nearly empty state when the calculated toner conveyance amount has been equal to or smaller than the first conveyance amount threshold value successively.

4. The image forming apparatus according to claim 1, wherein the first conveyance section includes a first motor configured to rotate the toner container so that the toner is conveyed from the toner container to the intermediate conveyance path.

5. The image forming apparatus according to claim 1, further comprising a second detector configured to detect concentration of the toner in the developing unit, wherein the second conveyance section includes a conveyance screw configured to convey the toner from the intermediate conveyance path to the developing unit and a second motor configured to rotate the conveyance screw, the controller controls the second motor based on a detection result obtained by the second detector, and the controller calculates the toner conveyance amount conveyed from the intermediate conveyance path, based on a rotation number of the second motor between the time when the first detector detects emptiness and the time when the first detector detects emptiness again.

6. The image forming apparatus according to claim 1, wherein when the calculated toner conveyance amount is equal to or larger than a second conveyance amount threshold value, the controller drives the first conveyance section for the first driving time period even when the first detector does not detect emptiness, and the second conveyance amount threshold value is set so as to decrease as a remaining toner amount in the toner container decreases.

7. The image forming apparatus according to claim 1, wherein the first driving time period is set so as to become longer as a remaining toner amount in the toner container decreases.

8. The image forming apparatus according to claim 1, wherein the controller estimates a remaining toner amount in the toner container based on the calculated toner conveyance amount, when the estimated remaining toner amount is equal to or smaller than a second gauge threshold value, the controller determines that the toner container is empty when, even after the first conveyance section is driven for a second driving time upon detection of emptiness by the first detector, the toner conveyance amount conveyed from the intermediate conveyance path is still equal to or smaller than a third conveyance amount threshold value, while the detection of the emptiness by the first detector has not yet been resolved, and the second driving time period is longer than the first driving time period.

9. The image forming apparatus according to claim 1, wherein the controller estimates a remaining toner amount in the toner container based on the calculated toner conveyance amount, and when the estimated remaining toner amount is equal to or smaller than a third gauge threshold value, the controller determines that the toner container is in the nearly empty state, even when the calculated toner conveyance amount has not been equal to or smaller than the first conveyance amount threshold value successively.

10. An image forming apparatus comprising:

a developing unit configured to develop an electrostatic latent image into a toner image;

a toner container containing toner with which the developing unit is replenished;

a conveyance section configured to convey the toner from the toner container to the developing unit;

a detector configured to detect concentration of the toner in the developing unit; and a controller configured to control the conveyance section; wherein every time the detector detects that the concentration of the toner in the developing unit has decreased to a level equal to or smaller than a prescribed value, the controller drives the conveyance section for a first driving time period, the controller calculates, based on formation information of the electrostatic latent image, a toner conveyance amount conveyed from the toner container between a time when the detector detects a decrease in the concentration and a time when the detector detects a decrease in the concentration again, and when the calculated toner conveyance amount has been equal to or smaller than a first conveyance amount threshold value successively, the controller determines that the toner container is in a nearly empty state.

11. The image forming apparatus according to claim 10, wherein the first conveyance amount threshold value is smaller than a value F(0) indicating a result of extrapolating a regression curve Y=F(X) into X=0%, and the regression curve Y=F(X) indicates a relationship between a remaining toner amount X in the toner container and a toner conveyance amount Y conveyed from the toner container between the time when the detector detects a decrease in the concentration and the time when the detector detects a decrease in the concentration again.

12. The image forming apparatus according to claim 10, wherein the controller estimates a remaining toner amount in the toner container based on the calculated toner conveyance amount, and in a case where the estimated remaining toner amount is equal to or smaller than a first gauge threshold value, the controller determines that the toner container is in the nearly empty state when the calculated toner conveyance amount has been equal to or smaller than the first conveyance amount threshold value successively.

13. The image forming apparatus according to claim 10, wherein the conveyance section includes a motor configured to rotate the toner container so that the toner is conveyed from the toner container to the developing unit.

14. The image forming apparatus according to claim 10, wherein in a case where the calculated toner conveyance amount is equal to or larger than a second conveyance amount threshold value, the controller drives the conveyance section for the first driving time period even when the detector does not detect a decrease in the concentration, and the second conveyance amount threshold value is set so as to decrease as the remaining toner amount in the toner container decreases.

15. The image forming apparatus according to claim 10, wherein the first driving time period is set so as to become longer as the remaining toner amount in the toner container decreases.

16. The image forming apparatus according to claim 10, wherein the controller estimates the remaining toner amount in the toner container based on the calculated toner conveyance amount, in a case where the estimated remaining toner amount is equal to or smaller than a second gauge threshold value, the controller determines that the toner container is empty when, even after the conveyance section is driven for a second driving time upon detection of a decrease in the concentration by the detector, the toner conveyance amount conveyed from the toner container is still equal to or smaller than a third conveyance amount threshold value while the detection of the decrease in the concentration by the detector has not yet been resolved, and the second driving time period is longer than the first driving time period.

17. The image forming apparatus according to claim 10, wherein the controller estimates a remaining toner amount in the toner container based on the calculated toner conveyance amount, and in a case where the estimated remaining toner amount is equal to or smaller than a third gauge threshold value, the controller determines that the toner container is in the nearly empty state even when the calculated toner conveyance amount has not been equal to or smaller than the first conveyance amount threshold value successively.

* * * * *